US007796922B2

(12) United States Patent
Ohyama et al.

(10) Patent No.: US 7,796,922 B2
(45) **Date of Patent: *Sep. 14, 2010**

(54) IMAGE FORMING APPARATUS HAVING A MAGNETIC FIELD GENERATING UNIT AT THE TONER CARRYING SECTION

(75) Inventors: Kunihiro Ohyama, Tokyo (JP); Satoru Yoshida, Kanagawa (JP); Tadashi Hayakawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 196 days.

This patent is subject to a terminal disclaimer.

(21) Appl. No.: 12/103,404

(22) Filed: Apr. 15, 2008

(65) Prior Publication Data

US 2008/0260432 A1 Oct. 23, 2008

(30) Foreign Application Priority Data

Apr. 20, 2007 (JP) ..... 2007-111364
Jan. 23, 2008 (JP) ..... 2008-012413
Feb. 5, 2008 (JP) ..... 2008-024647

(51) Int. Cl.
*G03G 15/08* (2006.01)

(52) U.S. Cl. ..... 399/258

(58) Field of Classification Search ..... 399/258–260, 399/277, 224, 229, 120
See application file for complete search history.

(56) References Cited

U.S. PATENT DOCUMENTS 6,104,900 A 8/2000 Ishikawa et al.
6,298,208 B1 10/2001 Kawamura et al.
6,505,026 B2 1/2003 Hayakawa et al.
6,560,431 B2 5/2003 Hosokawa
6,810,222 B2 10/2004 Ohyama
6,856,774 B2 2/2005 Sampe et al.
6,873,814 B2 3/2005 Ohjimi et al.
6,936,394 B2 * 8/2005 Okado et al. ..... 430/111.33
7,076,192 B2 7/2006 Tsuda et al.
7,149,461 B2 * 12/2006 Tamura et al. ..... 399/258
7,302,205 B2 11/2007 Shintani et al.

(Continued)

FOREIGN PATENT DOCUMENTS

CN 1550932 A 12/2004

(Continued)

OTHER PUBLICATIONS

U.S. Appl. No. 12/482,673.*

*Primary Examiner*—David M Gray
*Assistant Examiner*—Rodney Bonnette
(74) *Attorney, Agent, or Firm*—Oblon, Spivak, McClelland, Maier & Neustadt, L.L.P.

(57) ABSTRACT

An image forming apparatus is disclosed. The image forming apparatus includes a toner supplying device, a toner container, and a developing device. The toner supplying device supplies toners stored in the toner container to the developing device. The toner supplying device includes a toner tank which stores toners discharged from the toner container, a toner carrying section which carries the toners stored in the toner tank in an obliquely upward direction, and a toner dropping route which causes the toners carried by the toner carrying section to drop into the developing device by toner own weight. The toner carrying section controls an amount of the toners to flow into the toner dropping route.

20 Claims, 20 Drawing Sheets

U.S. PATENT DOCUMENTS

| | | | | |
|---|---|---|---|---|
| 7,321,744 | B2 | 1/2008 | Hosokawa et al. | |
| 2005/0226656 | A1 | 10/2005 | Tsuda et al. | |
| 2006/0115302 | A1 | 6/2006 | Hosokawa et al. | |
| 2007/0053723 | A1 * | 3/2007 | Iwata et al. | 399/259 |
| 2007/0104518 | A1 | 5/2007 | Ohyama | |
| 2007/0147902 | A1 | 6/2007 | Taguchi et al. | |
| 2007/0154243 | A1 | 7/2007 | Taguchi et al. | |
| 2007/0160392 | A1 | 7/2007 | Tsuda et al. | |
| 2007/0264052 | A1 | 11/2007 | Yoshida et al. | |
| 2007/0264054 | A1 | 11/2007 | Tsuda et al. | |
| 2008/0025761 | A1 | 1/2008 | Yoshida | |
| 2008/0085138 | A1 | 4/2008 | Yoshida | |

FOREIGN PATENT DOCUMENTS

| | | |
|---|---|---|
| CN | 1670635 A | 9/2005 |
| JP | 2002-268353 | 9/2002 |
| JP | 2003-330247 | 11/2003 |
| JP | 2004-139031 | 5/2004 |
| JP | 2005-301207 | 10/2005 |
| JP | 2006-84755 | 3/2006 |

* cited by examiner

IMAGE FORMING APPARATUS HAVING A MAGNETIC FIELD GENERATING UNIT AT THE TONER CARRYING SECTION

BACKGROUND OF THE INVENTION

1. Field of the Invention

The present invention generally relates to an image forming apparatus which uses a toner supplying device for supplying toners contained in a toner container to a developing device.

2. Description of the Related Art

In an image forming apparatus using an electrophotographic system such as a copying machine, a printer, a facsimile machine, and a multifunctional peripheral combining the above functions, a toner supplying device is publicly known in which toners contained in a toner container are supplied to a developing device at a position apart from the toner container (for example, in Patent Document 1).

In Patent Document 1, a toner container (toner bottle) which contains toners is detachably disposed from an image forming apparatus main body, and a developing device (process cartridge) is at a position apart from the toner container. In addition, a toner supplying device (toner carrying device) is between the toner container and the developing device. The toner supplying device provides a toner tank (sub hopper) which stores toners supplied from the toner container and a toner supplying pipe which supplies the toners contained in the toner tank to the developing device. The toner supplying pipe carries the toners in an obliquely downward direction and supplies the toners to the developing device. In addition, a carrying coil is inside the toner supplying pipe. That is, the toner supplying pipe carries the toners in the obliquely downward direction by using a toner carrying force of the carrying coil and toner own weight.

The toner supplying device suitably supplies the toners to the developing device corresponding to a consumed toner amount in a developer in the developing device.

In the image forming apparatus, it is not necessary for the toner container to be adjacent to the developing device. Therefore, the device design freedom is high and the image forming apparatus can be small sized.

In Patent Document 2, an image forming apparatus is disclosed. The image forming apparatus provides a cylinder-shaped toner container (toner cartridge). The toner container includes a spiral groove in an inner wall of a main body of the toner container. Then toners are discharged from a toner supplying opening of the main body of the cylinder-shaped toner container while rotating the main body.

Specifically, two protrusions are formed on the bottom surface of the main body of the toner container. The two protrusions have a 180-degree distribution angle with the rotational axle center of the main body as the reference. When the toner container is attached to the main body of the image forming apparatus, two claw members of a drive coupling on the main body of the image forming apparatus engage the corresponding protrusions of the toner container, and the toner container is rotated.

When the toner container is rotated, the toners are discharged from an opening of the main body of the toner container. The toners discharged from the opening of the main body of the toner container are carried to the developing device and are consumed in a developing process.

[Patent Document 1] Japanese Laid-Open Patent Application No. 2004-139031

[Patent Document 2] Japanese Laid-Open Patent Application No. 2003-330247

However, in Patent document 1, in some cases, the amount of toners supplied to the developing device is varied.

Since the toners are carried in the obliquely downward direction in the toner supplying pipe, when the supply of the toners to the developing device is stopped, even if the carrying coil is stopped, the toners remaining in the toner supplying pipe drop into the developing device due to the toner own weight. That is, in many cases, the amount of the toners more than a target amount is supplied to the developing device. In this case, the concentration of the toners in the developer (the ratio of the toners to the developer) becomes greater than a target concentration, the image density of an output image may be high, toners may be scattered, and the background image may be degraded due to lowering a toner charging amount.

In order to solve the above problem, by considering that an excessive amount of toners is supplied to the developing device after stopping the carrying coil, it can be assumed that the toner carrying force of the carrying coil is determined to be lower than a predetermined value beforehand. However, in this case, while the carrying coil is driven, the amount of toners to be supplied to the developing device may be insufficient, the image density of the output image may be lowered, and the developer may be adhered onto an image carrier or the output image.

Even if the toner supplying pipe is disposed in the horizontal direction, the above problem occurs. That is, when the toners are supplied to the developing device from the opening of the toner supplying pipe by using the toner own weight after carrying the toners in the horizontal direction, remaining toners near the opening may be dropped by the toner own weight right after stopping the carrying coil. Especially, when the liquidity of the toners is high, this problem remarkably occurs.

In Patent Document 2, when the main body of the toner container is rotated, in some cases, the amount of toners supplied to the developing device is varied due to a large load fluctuation for driving the main body.

The inventor of the present invention has studied several times about the load fluctuation and has found the following results. That is, the two protrusions formed on the bottom surface of the main body of the toner container are formed with the 180-degree distribution angle. When the toner container is attached to the main body of the image forming apparatus, the two claw members of the drive coupling repeat movements in which one claw member reaches a vertical status and the other claw reaches a horizontal status at the same timing. Consequently, when the main body of the toner container is driven, the load fluctuation becomes great.

In addition, when a driving source of the drive coupling is also used to drive a toner carrying screw which carries toners discharged from the toner container, in addition to driving the toner container, the load fluctuation may occur. Further, when a general-purpose DC motor which is normally used to build a plastic model is used as the driving source for lowering the cost, the load fluctuation remarkably occurs.

SUMMARY OF THE INVENTION

In a preferred embodiment of the present invention, there is provided an image forming apparatus using a toner supplying device in which the amount of toners to be supplied to a developing device in the image forming apparatus is not varied and a load fluctuation to rotate a toner container main body of a toner tank is small.

Features and advantages of the present invention are set forth in the description that follows, and in part will become apparent from the description and the accompanying drawings, or may be learned by practice of the invention according to the teachings provided in the description. Features and advantages of the present invention will be realized and attained by an image forming apparatus using a toner supplying device particularly pointed out in the specification in such full, clear, concise, and exact terms so as to enable a person having ordinary skill in the art to practice the invention.

To achieve one or more of these and other advantages, according to one aspect of the present invention, there is provided an image forming apparatus. The image forming apparatus includes plural toner supplying devices, plural toner containers, and plural developing devices. Each of the plural toner supplying devices supplies toners stored in the corresponding toner container to the corresponding developing devices. The toner supplying device includes a toner tank which stores toners discharged from the toner container, a toner carrying section which carries the toners stored in the toner tank, a toner dropping route which causes the toners carried by the toner carrying section to drop into the developing device by toner own weight, and a control unit which controls the amount of the toners to flow into the toner dropping route.

EFFECT OF THE INVENTION

According to an embodiment of the present invention, in an image forming apparatus, since a control unit controls the amount of toners to flow into a toner carrying route from a toner carrying section, variation of the amount of the toners to be supplied to a developing device is small.

In addition, in an image forming apparatus, in order to rotate a toner container main body of a toner container, engaging members are formed on a bottom section of the toner container main body and the engaging members are engaged with corresponding claw members of a drive coupling which transmits a rotational force to the toner container main body. Since the engaging members are disposed in a distribution angle other than 90 degrees and 180 degrees, load fluctuation in the drive coupling is small when the toner container main body is rotated, and the variation of the amount of toners to be supplied to a developing device is low.

BRIEF DESCRIPTION OF THE DRAWINGS

Features and advantages of the present invention will become more apparent from the following detailed description when read in conjunction with the accompanying drawings, in which.

DESCRIPTION OF THE PREFERRED EMBODIMENTS

Best Mode of Carrying Out the Invention

The best mode of carrying out the present invention is described with reference to the accompanying drawings.

First Embodiment

Referring to FIGS. 1 through 4, a first embodiment of the present invention is described.

First, a structure and operations of an image forming apparatus are described.

Figure 1:
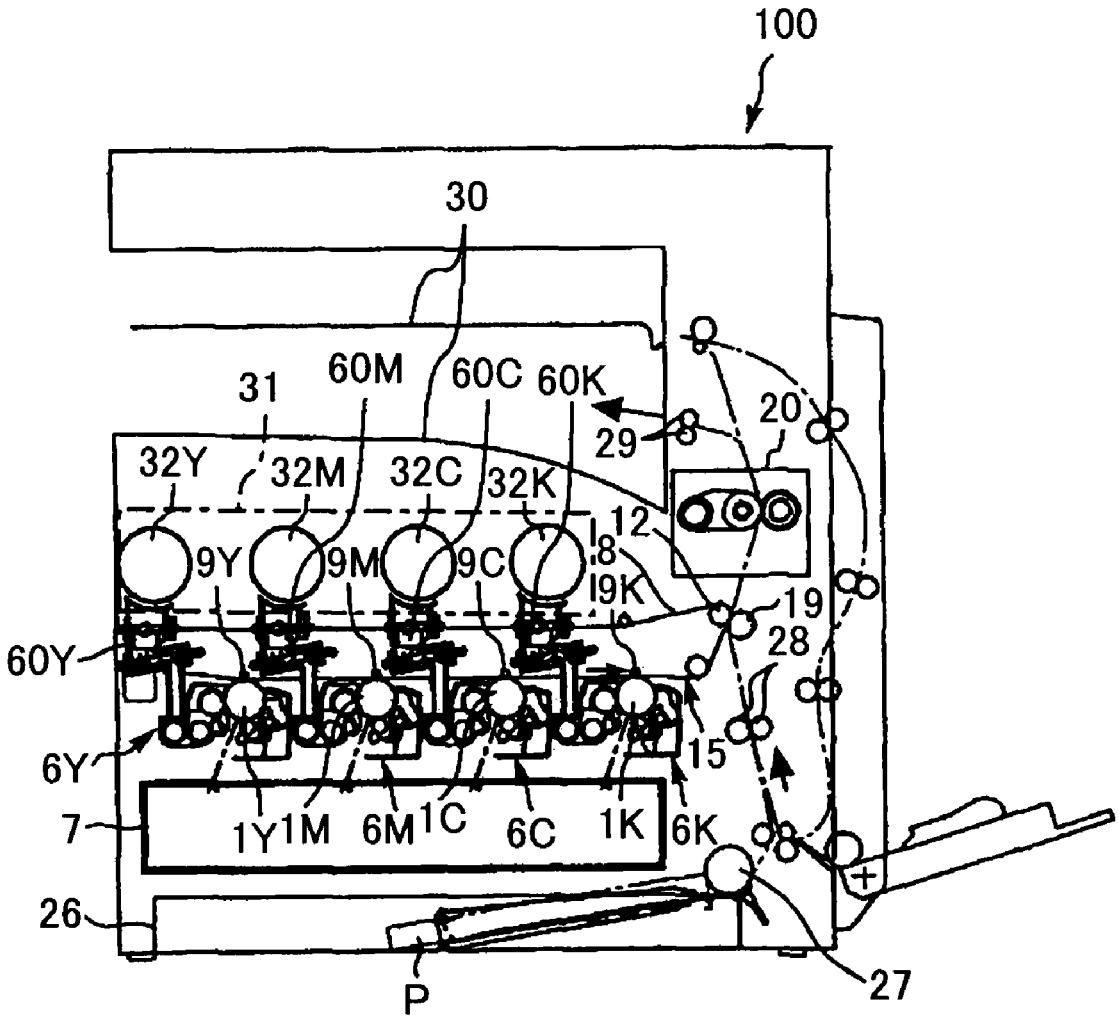
FIG. 1 is a schematic diagram showing a part of a structure of an image forming apparatus main body according to a first embodiment of the present invention.

FIG. 1 is a schematic diagram showing a part of a structure of an image forming apparatus main body 100 according to the first embodiment of the present invention.

As shown in FIG. 1, in a toner container storing section 31 at an upper part of the image forming apparatus main body 100, four toner containers 32Y, 32M, 32C, and 32K corresponding to four colors yellow, magenta, cyan, and black are detachably attached to the toner container storing section 31.

An intermediate transfer unit 15 is under the toner container storing section 31. The intermediate transfer unit 15 includes an intermediate transfer belt 8, and image forming sections 6Y, 6M, 6C, and 6K corresponding to the four colors yellow, magenta, cyan, and black facing the intermediate transfer belt 8.

Toner supplying devices 60Y, 60M, 60C, and 60K are under the corresponding toner containers 32Y, 32M, 32C, and 32K. Toners contained in the toner containers 32Y, 32M, 32C, and 32K are supplied to the corresponding developing devices in the image forming sections 6Y, 6M, 6C, and 6K by the corresponding toner supplying devices 60Y, 60M, 60C, and 60K.

Some elements in FIG. 1 which are not described above are described below.

Figure 2:
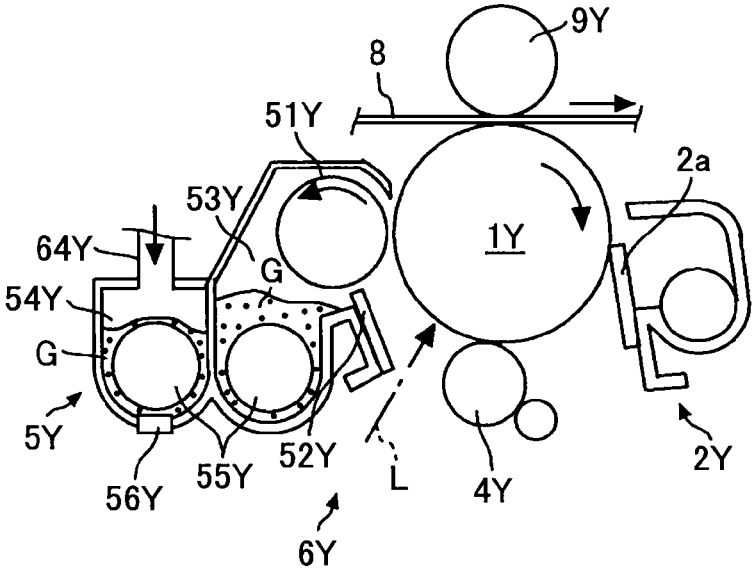
FIG. 2 is a schematic diagram showing a structure of an image forming section shown in FIG. 1.

FIG. 2 is a schematic diagram showing a structure of the image forming section 6Y shown in FIG. 1.

As shown in FIG. 2, the image forming section 6Y corresponding to the yellow color includes a photoconductor drum 1Y, a charging section 4Y facing the photoconductor drum 1Y, a developing device 5Y, a cleaning section 2Y, and a discharging section (not shown). Image forming processes (a charging process, an exposing process, a developing process, a transferring process, and a cleaning process) are performed on the photoconductor drum 1Y, and a yellow image is formed on the photoconductor drum 1Y.

Each of the image forming sections 6M, 6C, and 6K has a structure almost identical to the structure of the image forming section 6Y and forms a corresponding color image. Therefore, in the following, the image forming section 6Y is mainly described while omitting the descriptions of the image forming sections 6M, 6C, and 6K.

In FIG. 2, the photoconductor drum 1Y is rotated clockwise by a driving motor (not shown). Then the surface of the photoconductor drum 1Y is uniformly charged by the charging section 4Y (the charging process).

The surface of the photoconductor drum 1Y reaches a position where laser beams L are irradiated from a exposing device 7 (see FIG. 1) and an electrostatic latent image corresponding to yellow is formed at the position by being exposed by the laser beams (the exposing process).

Then the surface of the photoconductor drum 1Y on which the electrostatic latent image is formed reaches a position facing the developing device 5Y, the electrostatic latent image is developed at the position, and a yellow toner image is formed (the developing process).

Then the surface of the photoconductor drum 1Y on which the toner image is formed reaches a position facing a primary transfer bias roller 9Y and the toner image on the photoconductor drum 1Y is transferred onto the intermediate transfer belt 8 at the position (a primary transfer process). At this time, a small amount of toners which are not transferred onto the intermediate transfer belt 8 remain on the photoconductor drum 1Y.

Then the surface of the photoconductor drum 1Y reaches a position facing the cleaning section 2Y and the toners remaining on the surface of the photoconductor drum 1Y are mechanically removed by a cleaning blade 2*a* (the cleaning process).

Finally, the surface of the photoconductor drum 1Y reaches a position facing the discharging section and electric charges remaining on the surface of the photoconductor drum 1Y are discharged.

By the above processes, the image forming process on the photoconductor drum 1Y is completed.

The above image forming process is performed in the image forming sections 6M, 6C, and 6K, similar to in the image forming section 6Y. That is, the laser beams L corresponding to image information are irradiated on the corresponding photoconductor drums 1M, 1C, and 1K from the exposing device 7 disposed under the image forming sections 6M, 6C, and 6K. Specifically, the exposing device 7 causes a light source to emit the laser beams L and irradiates the laser beams L onto the corresponding photoconductor drums 1M, 1C, and 1K via plural optical elements while the laser beams L are scanned by a rotating polygon mirror.

After the developing process, the toner images formed on the corresponding photoconductor drums 1Y, 1M, 1C, and 1K are transferred onto the intermediate transfer belt 8 by being superposed. With this, a color image is formed on the intermediate transfer belt 8.

Returning to FIG. 1, the intermediate transfer unit 15 includes the intermediate transfer belt 8, four primary transfer bias rollers 9Y, 9M, 9C, and 9K, a secondary transfer backup roller 12, plural tension rollers (not shown), and an intermediate transfer cleaning section (not shown). The intermediate transfer belt 8 is sustained by plural rollers and is endlessly rotated in the arrow direction by the secondary transfer backup roller 12.

A primary transfer nip is formed by sandwiching the intermediate transfer belt 8 between the four primary transfer bias rollers 9Y, 9M, 9C, and 9K and the four photoconductor drums 1Y, 1M, 1C, and 1K. A transfer bias voltage whose polarity is inverted relative to the polarity of the toners is applied to the four primary transfer bias rollers 9Y, 9M, 9C, and 9K.

The intermediate transfer belt 8 sequentially passes through the primary transfer nips of the primary transfer bias rollers 9Y, 9M, 9C, and 9K by being moved in the arrow direction. With this, the toner images on the corresponding photoconductor drums 1Y, 1M, 1C, and 1K are primarily transferred onto the intermediate transfer belt 8 by being superposed.

The intermediate transfer belt 8 onto which the toner images are transferred by being superposed reaches a position facing a secondary transfer roller 19. A secondary transfer nip is formed at the position where the intermediate transfer belt 8 is sandwiched between the secondary transfer backup roller 12 and the secondary transfer roller 19. Then the four-color toner image formed on the intermediate transfer belt 8 is transferred onto a recording medium P (for example, paper) carried to the position of the secondary nip. At this time, toners which are not transferred onto the recording medium P remain on the intermediate transfer belt 8.

Then the intermediate transfer belt 8 reaches a position facing the intermediate transfer cleaning section and the toners remaining on the intermediate transfer belt 8 are removed at the position.

With this, the transfer process which is performed on the intermediate transfer belt 8 is completed.

The recording medium P is carried to the position of the secondary nip from a paper feeding section 26 at a lower part of the image forming apparatus main body 100 via a paper feeding roller 27, a pair of registration rollers 28, and so on.

Specifically, the plural recording media P (many pieces of paper) are stored in the paper feeding section 26 by being stacked. When the paper feeding roller 27 is rotated counter-clockwise, a top recording medium P is carried to a poison between the pair of registration rollers 28.

The recording medium P carried by the pair of registration rollers 28 is temporarily stopped at a roller nip position of the pair of registration rollers 28 whose rotation is stopped. Then the pair of registration rollers 28 is rotated again at timing when the color image on the intermediate transfer belt 8 reaches the roller nip position, and the recording medium P is carried to the secondary transfer nip. With this, the color image is transferred onto the recording medium P.

The recording medium P onto which the color image is transferred at the position of the secondary transfer nip is carried to a fixing section 20 and the color image on the recording medium P is fixed by heat and pressure from a corresponding fixing belt and a pressure applying roller of the fixing section 20.

The recording medium P on which the color image is formed is output to a stacking section 30 via a pair of paper outputting rollers 29. When plural recording media P are output, the output plural recording media P are sequentially stacked on the stacking section 30.

By the above processes, the image forming process in the image forming apparatus main body 100 is completed.

Next, returning to FIG. 2, a structure and operations of the developing device 5Y are described.

The developing device 5Y includes a developing roller 51Y facing the photoconductor drum 1Y, a doctor blade 52Y facing the developing roller 51Y, developer containers 53Y and 54Y, carrying screws 55Y in the corresponding developer containers 53Y and 54Y, and a concentration detecting sensor 56Y for detecting toner concentration in a developer G. The developing roller 51Y includes a magnet (not shown) secured inside the developing roller 51Y and a sleeve which is rotated around the magnet. The developer G formed of a toner carrier and toners is contained in the developer containers 53Y and 54Y. The developer container 54Y is connected to a toner dropping route 64Y via an opening formed at an upper side of the developer container 54Y.

Operations of the developing device 5Y are described.

The sleeve of the developing roller 51Y is rotated in the arrow direction. The developer G carried on the developing roller 51Y by a magnetic field generated by the magnet is moved on the developing roller 51Y while the sleeve is rotated.

The toner concentration in the developer G is adjusted to be a value within a predetermined range. Specifically, in order to adjust the toner concentration, toners contained in the toner container 32Y (see FIG. 1) are supplied to the developer container 54Y via the toner supplying device 60Y (see FIG. 1) corresponding to a consumed amount of toners in the developing device 5Y. The toner supplying device 60Y is described below in detail.

The toners supplied to the developer container 54Y are mixed with the developer G in the developer container 54Y and stirred by the carrying screws 55Y, and the developer G is circulated in the two developer containers 53Y and 54Y while the developer G is stirred by the carrying screws 55Y. The developer G is moved in the direction perpendicular to the plane of the paper of FIG. 2.

The toners in the developer G are adhered to a toner carrier by a friction charge with the toner carrier and are carried on the developing roller 51Y with the toner carrier by a magnetic force formed on the developing roller 51Y.

The developer G carried on the developing roller 51Y reaches the doctor blade 52Y by being carried in the arrow direction. The amount of the developer G on the developing roller 51Y is adjusted to be a suitable value by the doctor blade 52Y and the developer G whose amount is adjusted is carried to a position facing the photoconductor drum 1Y. The position is a developing region. The toners in the developer G are adhered onto an electrostatic latent image formed on the photoconductor drum 1Y by an electric field generated in the developing region. The developer G remaining on the developing roller 51Y reaches an upper part in the developer container 53Y by the rotation of the sleeve and the remaining developer G is dropped from the developing roller 51Y.

Figure 3:
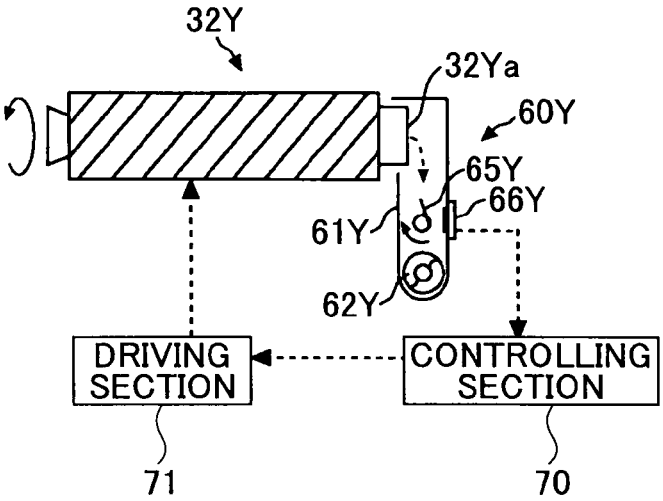
FIG. 3 is a schematic diagram showing a part of the image forming apparatus main body including a toner container and a toner tank.
Figure 4:
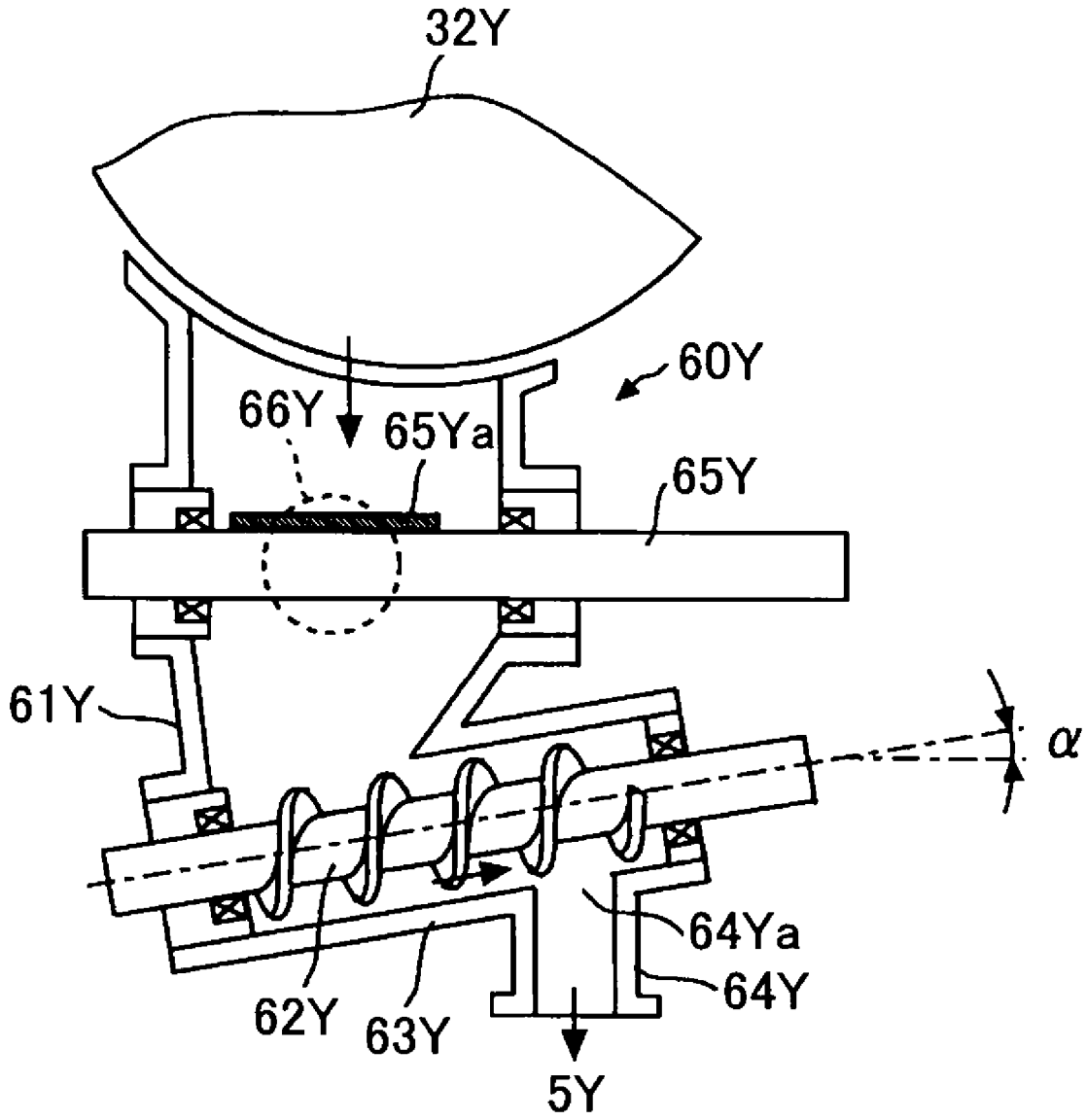
FIG. 4 is a schematic diagram showing a part of the structure of the image forming apparatus main body including a toner supplying device.

Next, referring to FIGS. 3 and 4, the toner supplying device 60Y which supplies toners contained in the toner container 32Y to the developing device 5Y is described.

FIG. 3 is a schematic diagram showing a part of the image forming apparatus main body 100 including the toner container 32Y and the toner tank 61Y. FIG. 4 is a schematic diagram showing a part of the structure of the image forming apparatus main body 100 including the toner supplying device 60Y.

In FIG. 1, the toners contained in the corresponding toner containers 32Y, 32M, 32C, and 32K in the toner container storing section 31 are suitably supplied to the corresponding developing devices by the corresponding toner supplying devices 60Y, 60M, 60C, and 60K based on the consumed amounts of the corresponding toners. The structure of each of the toner supplying devices 60Y, 60M, 60C, and 60K is almost the same. Therefore, the toner supplying device 60Y is described as the representative.

In FIG. 3, when the toner container 32Y is installed in the toner container storing section 31, a sealing member (not shown) including a cap and a shutter is moved synchronized with the installation of the toner container 32Y, and a toner outlet 32Ya of the toner container 32 is opened. With this, the toners contained in the toner container 32Y are discharged from the toner outlet 32Ya and are stored in a toner tank 61Y of the toner supplying device 60Y.

The toner container 32Y is an approximately cylinder-shaped toner bottle, and includes a spiral protrusion on the internal circumferential surface of the toner container 32Y. When the spiral protrusion is viewed from the outside, a spiral groove is taken. When the toner container 32Y is rotated in the arrow direction by a driving section 71, the spiral protrusion discharges the toners from the toner outlet 32Ya. That is, when the toner container 32Y is suitably rotated by the driving section 71, the toners are suitably supplied to the toner tank 61Y.

When the service life of each of the toner containers 32Y, 32M, 32C, and 32K has passed; that is, when almost all toners in the toner container have been consumed, an old one is replaced with a new one.

In FIG. 4, the toner supplying device 60Y includes the toner tank 61Y, a toner carrying screw 62Y, a toner carrying tube 63Y, the toner dropping route 64Y, a toner stirring member 65Y, and a toner end sensor 66Y (toner amount detecting unit).

The toner tank 61Y is under the toner outlet 32Ya (see FIG. 3) of the toner container 32Y and stores the toners discharged from the toner container 32Y. The bottom part of the toner tank 61Y is connected to the upstream side of the toner carrying screw 62Y and the toner carrying tube 63Y.

The toner end sensor 66Y is on a wall surface of the toner tank 61Y at a position having a predetermined height from the bottom surface of the toner tank 61Y. The toner end sensor 66Y detects a signal when the amount of the toners stored in the toner tank 61Y becomes a value less than a predetermined value. As the toner end sensor 66Y, a piezoelectric sensor can be used. In FIG. 3, when the toner end sensor 66Y detects a signal that the amount of the toners stored in the toner tank 61Y has become a value less than a predetermined value, the signal is sent to a controlling section 70. The controlling section 70 controls the driving section 71 to rotate the toner container 32Y for a predetermined period so as to supply toners to the toner tank 61Y. When the toner end sensor 66Y continues to detect the signal even if the driving section 71 repeats rotating the toner tank 32Y, the controlling section 70 determines that no toners remain in the toner container 32Y. Then the controlling section 70 displays a message which instructs to replace the existing toner container 32Y with a new one on a displaying section (not shown) of the image forming apparatus main body 100.

The toner stirring member 65Y is at an inner center position of the toner tank 61Y near the toner end sensor 66Y for preventing the toners stored in the toner tank 61Y from being condensed. The toner stirring member 65Y is formed by disposing a flexible member 65Ya at a shaft (not shown). When the shaft is rotated clockwise (see FIG. 3), the toner stirring member 65Y stirs the toners in the toner tank 61Y.

In addition, since the tip of the flexible member 65Ya of the toner stirring member 65Y contacts the detecting surface of the toner end sensor 66Y with a rotational cycle of the toner stirring member 65Y, lowering the detecting accuracy due to adhering toners onto the detecting surface of the toner end sensor 66Y is prevented. As shown in FIG. 3, since the toner stirring member 65Y is rotated clockwise, the flexible member 65Ya contacts the detecting surface of the toner end sensor 66Y at the vertical wall surface of the toner tank 61Y from the upper side to the lower side. Therefore, the toners near the detecting surface cyclically receive an action in which the toners are scraped in the gravitational force direction. Under the above conditions, since the toner end sensor 66Y detects toners on the detecting surface, the detecting accuracy of the toner end sensor 66Y becomes high. One end of the shaft of the toner stirring member 65Y is connected to the driving section 71 and the shaft is rotated by the driving section 71.

In FIG. 4, the toner carrying screw 62Y and the toner carrying tube 63Y carry the toners stored in the toner tank 61Y in the obliquely upward direction (the arrow direction). Specifically, the toner carrying screw 62Y and the toner carrying tube 63Y linearly carry the toners from the bottom part (the lowest part) of the toner tank 61Y to a position above the developing device 5Y (a toner dropping opening 64Ya of the toner dropping route 64Y). The toners reaching at the toner dropping opening 64Ya are supplied to the developer container 54Y (see FIG. 2) of the developing device 5 by the toner own weight via the toner dropping route 64Y.

The toner carrying screw 62Y in the toner carrying tube 63Y carries the toners by being rotated in a predetermined direction. The toner carrying screw 62Y and the toner carrying tube 63Y form a toner carrying section.

The toner carrying screw 62Y is a screw member in which a helicoid is spirally formed on a shaft and is rotatably sustained in the toner carrying tube 63Y via bearings (not shown). One end of the toner carrying screw 62Y is connected to the driving section 71 (see FIG. 3) and the toner carrying screw 62Y is rotated by the driving section 71. The toner carrying screw 62Y can be formed of a metal material or a resin material.

The upstream side of the toner carrying tube 63Y is connected to the toner tank 61Y and the downstream side of the toner carrying tube 63Y is connected to the toner dropping route 64Y via the toner dropping opening 64Ya. The toner carrying tube 63Y is formed of a resin material. The gap between the external diameter of the toner carrying screw 62Y and the inner wall of the toner carrying tube 63Y is approximately 0.1 to 0.2 mm. With this, the toners are smoothly carried in the obliquely upward direction against the gravitational force by the toner carrying screw 62Y and the toner carrying tube 63Y.

As described above, in the first embodiment of the present invention, the toners stored in the toner tank 61Y are carried in the obliquely upward direction by the toner carrying screw 62Y and the toner carrying tube 63Y, and the carried toners are supplied to the developing device 5Y by the toner own weight via the toner dropping route 64Y. With this, when the rotation of the toner carrying screw 62Y is stopped and the supply of the toners to the developing device 5Y is stopped, the toners remaining in the toner carrying tube 63Y are hardly dropped into the developing device 5Y via the toner dropping route 64Y. That is, since the toner carrying screw 62Y and the toner carrying tube 63Y carry the toners stored in the toner tank 61Y in the obliquely upward direction, the toner carrying screw 62Y and the toner carrying tube 63Y can operate as a control unit for controlling the amount of toners to flow into the toner dropping route 64Y.

Specifically, the toners remaining at a position apart from the toner dropping opening 64Ya slide toward the toner tank 61Y along the oblique toner carrying tube 63Y or stay at the position. In addition, the toners remaining at a position near the toner dropping opening 64Ya in the toner carrying tube 63Y are not greatly dropped from the toner dropping opening 64Ya by the toner own weight even if a great shock is given to the apparatus, and the toners slide toward the toner tank 61Y along the oblique toner carrying tube 63Y or stay at the position.

Therefore, even if the rotation and non-rotation of the toner carrying screw 62Y are repeated, the amount of toners to be supplied to the developing device 5Y can be controlled at high accuracy; that is, the toners can be stably supplied to the developing device 5Y. Consequently, the variation of the toner concentration in the developer G can be prevented. That is, the image density of an output image can be prevented from being high, the toners can be prevented from being scattered, and the background image can be prevented from being degraded.

In addition, even if the rotation and non-rotation of the toner carrying screw 62Y are repeated, a large amount of toners remaining in the toner carrying tube 63Y are not supplied to the developing device 5Y. Therefore, the amount of toners remaining in the toner tank 61Y is not greatly varied. Consequently, error detection by the toner end sensor 66Y can be prevented.

In addition, when a cover of the image forming apparatus main body 100 is opened or closed or the toner container 32Y is attached to or detached from the toner container storing section 31, even if a large vibration caused by the above operations is applied to the toner carrying screw 62Y and the toner carrying tube 63Y, toners remaining in the toner carrying screw 62Y and the toner carrying tube 63Y are hardly dropped into the developing device 5Y via the toner dropping route 64Y.

Further, when toners are immediately supplied into an empty toner carrying screw 62Y and an empty toner carrying tube 63Y from the toner container 32Y at an initial stage, or an image whose image forming area is large is continuously formed (printed) many times, even if the liquidity of toners becomes high, the toners remaining in the toner carrying screw 62Y and the toner carrying tube 63Y are hardly dropped into the developing device 5Y via the toner dropping route 64Y.

In FIG. 4, in order to surely obtain the above effect, it is preferable that the inclination angle $\alpha$ of the toner carrying screw 62Y and the toner carrying tube 63Y relative to the horizontal direction be 5 or more degrees ($\alpha \geqq 5°$). However, when the inclination angle $\alpha$ becomes too large, the toner carrying ability by the toner carrying screw 62Y and the toner carrying tube 63Y is lowered and the height of the apparatus becomes great. Therefore, in the first embodiment of the present invention, the inclination angle $\alpha$ is approximately 10 degrees.

The inventor of the present invention has performed an experiment. In the experiment, two toner supplying devices 60Y were used. In the first toner supplying device 60Y, the inclination angle $\alpha$ is 10 degrees, and in the second toner supplying device 60Y, the inclination angle $\alpha$ is 0 degrees (toners were horizontally carried). Then a toner amount dropped from the toner dropping opening 64Ya to the developing device 5Y was measured right after stopping the toner carrying screw 62Y.

In the results of the experiment, in the first toner supplying device 60Y ($\alpha$=10°), only 0.0 to 0.2 grams of the toners were dropped into the developing device 5Y via the toner dropping opening 64Ya from 8 grams of the toners remaining in the toner tank 61Y. In the second toner supplying device 60Y ($\alpha$=0°), approximately 2 grams of the toners were dropped into the developing device 5Y via the toner dropping opening 64Ya from 8 grams of the toners remaining in the toner tank 61Y; that is, approximately 25% of the remaining toners was dropped. In addition, in the first toner supplying device 60Y ($\alpha$=10°), since the amount of toners dropped into the developing device 5Y was small, the toner concentration in the developer G in the developing device 5Y was not largely changed. However, in the second toner supplying device 60Y ($\alpha$=0°), since the amount of toners dropped into the developing device 5Y was large, the toner concentration in the developer G in the developing device 5Y became high.

In the experiment, in order to make clear the difference between the two toner supplying devices 60Y, relatively high liquidity toners were used. Specifically, in the toners, a polyester based resin was used as a base resin and the grain diameter of the toners was 6 to 12.5 μm.

As described above, in the first embodiment of the present invention, the toners stored in the toner tank 61Y are carried in the obliquely upward direction and the carried toners are supplied to the developing device 5Y by the toner own weight. Therefore, the variation of the amount of the toners to be supplied to the developing device 5Y can be prevented. That is, since the toner carrying screw 62Y and the toner carrying tube 63Y can operate as a control unit for controlling the amount of toners to flow into the toner dropping route 64Y, the variation of the amount of the toners to be supplied to the developing device 5Y can be prevented.

Second Embodiment

Next, referring to FIGS. 1, and 5 through 9, a second embodiment of the present invention is described.

In the second embodiment of the present invention, when an element is almost identical to an element in the first embodiment of the present invention, a same reference number as that in the first embodiment is used for the element.

Figure 5:
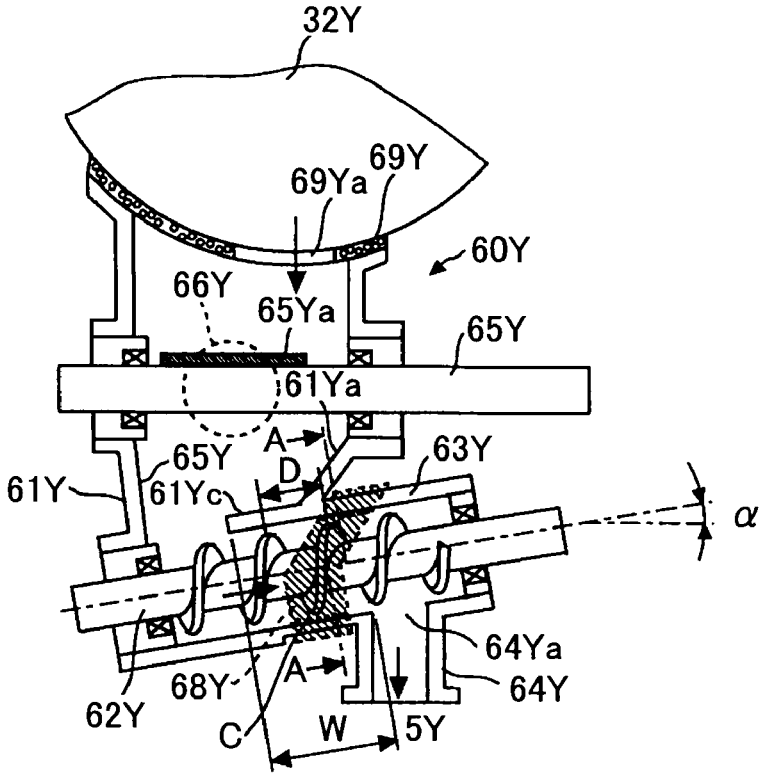
FIG. 5 is a schematic diagram showing a part of the structure of the image forming apparatus main body including the toner supplying device according to a second embodiment of the present invention.
Figure 6:
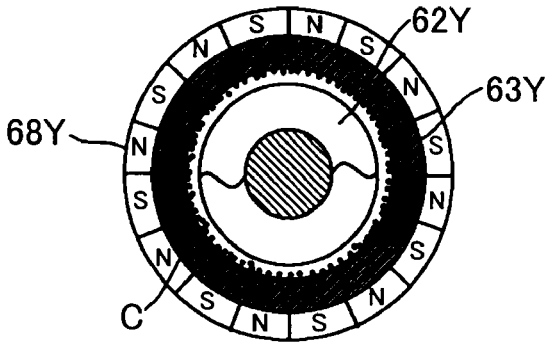
FIG. 6 is a cross-sectional view of the structure shown in FIG. 5 along line A-A of FIG. 5.
Figure 7:
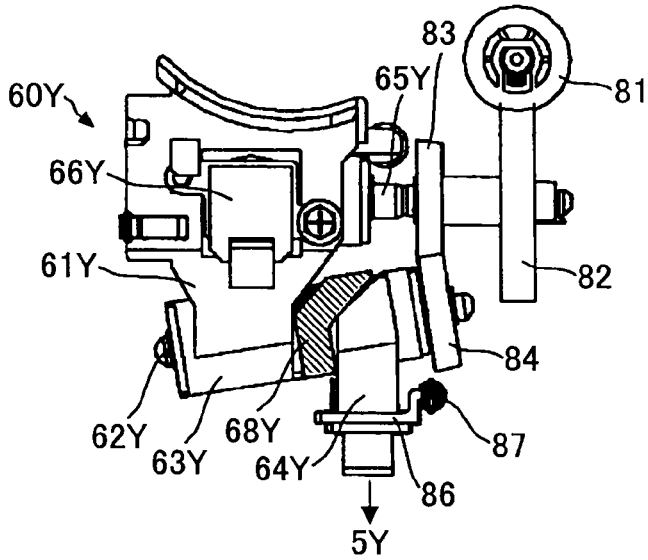
FIG. 7 is an external view of the toner supplying device according to the second embodiment of the present invention.
Figure 8:
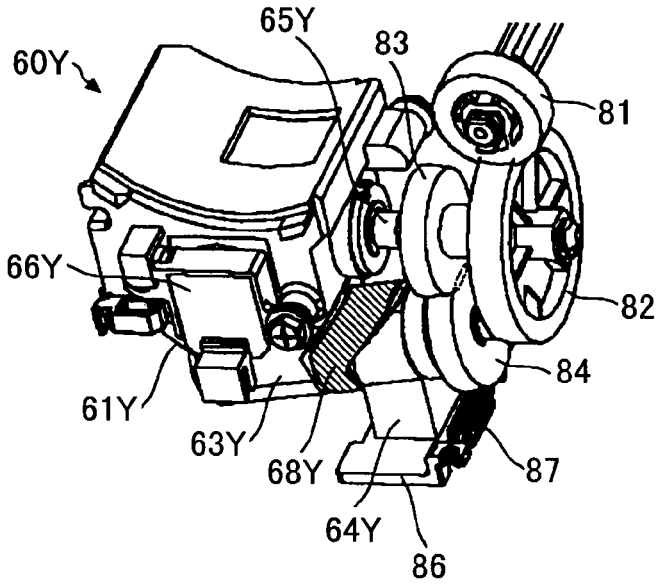
FIG. 8 is a perspective view of the toner supplying device according to the second embodiment of the present invention.

FIG. 5 is a schematic diagram showing a part of the structure of the image forming apparatus main body 100 including a toner supplying device 60Y according to the second embodiment of the present invention. In FIG. 5, a magnetic field generating unit 68Y (permanent magnet) is newly disposed. FIG. 6 is a cross-sectional view of the structure shown in FIG. 5 along line A-A of FIG. 5. FIG. 7 is an external view of the toner supplying device 60Y according to the second embodiment of the present invention. FIG. 8 is a perspective view of the toner supplying device 60Y according to the second embodiment of the present invention.

The toner supplying device 60Y in the second embodiment of the present invention includes the permanent magnet 68Y which generates a magnetic field for the toner carrying tube 63Y. In addition, a toner carrier C formed of a magnetic substance is used for carrying toners. The developer G includes the toner carrier C and the toners.

The external view of the toner supplying device 60Y shown in FIGS. 7 and 8 is almost identical to that of the toner supplying device 60Y in the first embodiment of the present invention except for the permanent magnet 68Y.

As shown in FIGS. 5 through 8, similar to the toner supplying device 60Y in the first embodiment of the present invention, the toner supplying device 60Y in the second embodiment of the present invention includes the toner tank 61Y, the toner carrying screw 62Y, the toner carrying tube 63Y, the toner dropping route 64Y, the toner stirring member 65Y, and the toner end sensor 66Y. The toner carrying screw 62Y and the toner carrying tube 63Y form a toner carrying section, carry the toners stored in the toner tank 61Y in the obliquely upward direction, and can operate as a control unit for controlling the amount of toners to flow into the toner dropping route 64Y.

As shown in FIGS. 7 and 8, a bevel gear 82 having a twisting angle of 45 degrees is attached to one end of the shaft of the toner stirring member 65Y, and a driving force is transmitted to the toner stirring member 65Y via a bevel gear 81 having a twisting angle of 45 degrees engaged with the bevel gear 82. In addition, a skew gear 84 is attached to one end of the toner carrying screw 62Y, and a driving force is transmitted to the toner carrying screw 62Y via a skew gear 83 attached to the shaft of the toner stirring member 65Y which skew gear 83 is engaged with the skew gear 84. The above structure is omitted in the first embodiment of the present invention.

In addition, as shown in FIGS. 7 and 8, a shutter 86 is attached to the toner dropping route 64Y, and the shutter 86 is opened or closed when the developing device 5Y is attached to or detached from the image forming apparatus main body 100. Specifically, when the developing device 5Y is attached to the image forming apparatus main body 100, the shutter 86 moves to open the toner dropping route 64Y by being pushed by the developing device 5Y against a force of a spring 87. When the developing device 5Y is detached from the image forming apparatus main body 100, the shutter 86 moves to close the toner dropping route 64Y by the force of the spring 87. With this, when the developing device 5Y is detached from the image forming apparatus main body 100, the toners cannot be scattered in the image forming apparatus main body 100 from the toner dropping route 64Y. The above structure is omitted in the first embodiment of the present invention.

In the second embodiment of the present invention, as the control unit for controlling the amount of toners to flow into the toner dropping route 64Y from the toner carrying screw 62Y and the toner carrying tube 63Y, the permanent magnet 68Y and the toner carrier C of the magnetic substance are included.

As shown in FIGS. 5 through 8, the permanent magnet 68Y generates a magnetic field in the toner carrying tube 63Y, and is disposed on the external circumferential surface (external wall) of the toner carrying tube 63Y. The permanent magnet 68Y attracts the toner carrier C of the magnetic substance to the internal wall of the toner carrying tube 63Y.

When the toner carrier C is attracted to the inner wall of the toner carrying tube 63Y by the permanent magnet 68Y on the external wall of the toner carrying tube 63Y, even if the rotation of the toner carrying screw 62Y is stopped when the supply of the toners to the developing device 5Y is stopped, the toners remaining in the toner carrying tube 63Y are likely to stay at the toner carrier C. Therefore, fewer of the toners are dropped into the developing device 5Y via the toner dropping route 64Y by the toner own weight. That is, in addition to the oblique toner carrying screw 62Y and the oblique toner carrying tube 63Y, the permanent magnet 68Y and the toner carrier C can operate as the control unit for controlling the amount of toners to be dropped from the toner carrying screw 62Y and the toner carrying tube 63Y into the toner dropping route 64Y right after stopping the operation of the toner supplying device 60Y.

Specifically, the toners remaining at a position apart from the toner dropping opening 64Ya slide toward the toner tank 61Y along the oblique toner carrying tube 63Y or stay at the position of the toner carrier C. In addition, the toners remaining at a position near the toner dropping opening 64Ya in the toner carrying tube 63Y are not greatly dropped from the toner dropping opening 64Ya by the toner own weight even if a great shock is given to the apparatus, and the toners slide toward the toner tank 61Y along the oblique toner carrying tube 63Y or stay at the position of the toner carrier C.

Therefore, even if the rotation and non-rotation of the toner carrying screw 62Y are repeated, the amount of toners to be supplied to the developing device 5Y can be controlled at high accuracy; that is, the toners can be stably supplied to the developing device 5Y. Consequently, the variation of the toner concentration in the developer G can be prevented. That is, the image density of an output image can be prevented from being high, toners can be prevented from being scattered and the background image can be prevented from being degraded.

In addition, even if the rotation and non-rotation of the toner carrying screw 62Y are repeated, a large amount of toners remaining in the toner carrying tube 63Y are not supplied to the developing device 5Y. Therefore, the amount of toners remaining in the toner tank 61Y is not greatly varied. Consequently, error detection by the toner end sensor 66Y can be prevented.

In addition, when a cover of the image forming apparatus main body 100 is opened or closed or the toner container 32Y is attached to or detached from the toner container storing section 31, even if a large vibration caused by the above operations is applied to the toner carrying screw 62Y and the toner carrying tube 63Y, the toners remaining in the toner carrying screw 62Y and the toner carrying tube 63Y are hardly dropped into the developing device 5Y via the toner dropping route 64Y.

Further, when toners are immediately supplied into an empty toner carrying screw 62Y and an empty toner carrying tube 63Y from the toner container 32Y at an initial stage, or an image whose image forming area is large is continuously formed (printed) many times, even if the liquidity of the toners becomes high, the toners remaining in the toner carrying screw 62Y and the toner carrying tube 63Y are hardly dropped into the developing device 5Y via the toner dropping route 64Y.

Especially, in the second embodiment of the present invention, since the toner carrier C (magnetic substance) is used to carry the toners in the toner carrying tube 63Y, even if the toner carrier C is dropped into the developing device 5Y via the toner dropping route 64Y from the toner carrying screw 62Y and the toner carrying tube 63Y, the dropped toner carrier C is the same as the toner carrier C in the developer G, and a side effect by the dropped toner carrier C hardly occurs in the developing device 5Y. In addition, since the posture of the toner carrier C can be freely changed in the narrow gap between the toner carrying screw 62Y and the toner carrying tube 63Y, the toner carrier C does not damage the toner carrying screw 62Y and the toner carrying tube 63Y.

The toner carrier C is supplied to the toner carrying screw 62Y and the toner carrying tube 63Y when the image forming apparatus main body 100 is delivered to a user.

In addition, in the second embodiment of the present invention, since the permanent magnet 68 is used as the magnetic field generating unit, when the image forming apparatus main body 100 is compared with an image forming apparatus main body using an electromagnet as the magnetic field generating unit, the image forming apparatus main body 100 can be manufactured with a low cost and a small size.

It is preferable that the magnetization direction of the permanent magnet 68Y be only a direction toward the inside of the toner carrying screw 62Y and the toner carrying tube 63Y. Specifically, as shown in FIG. 6, the permanent magnet 68Y is formed of a one-surface multiple-pole magnetization permanent magnet in which S poles and N poles are alternately arrayed by using a publicly-known manufacturing method. With this, abnormal operations caused by an influence of the magnetic field of the permanent magnet 68Y on the outside of the toner carrying screw 62Y and the toner carrying tube 63Y can be prevented. The abnormal operations are, for example, abnormal behavior of the developer G in the developing device 5Y and an error detection by the toner end sensor 66Y.

In FIG. 5, the thickness of the toner carrying tube 63Y with the permanent magnet 68Y installed is less than the thickness of the toner carrying tube 63Y without the permanent magnet 68Y installed. With this, the magnetic force of the permanent magnet 68Y is likely to influence the inside of the toner carrying tube 63Y.

In the second embodiment of the present invention, the magnetic force (magnetic flux density) of the permanent magnet 68Y is 50 mT (milli-tesla) or more, and the width of the permanent magnet 68Y is approximately 6 mm in the toner carrying direction.

As shown in FIG. 5, similar to the first embodiment of the present invention (description is omitted), in the second embodiment of the present invention, a right-side wall surface 61Ya of the toner tank 61Y is gently slanted compared with a left-side wall surface 61Yb of the toner tank 61Y. A sponge seal 69Y and a toner input opening 69Ya formed at a part of the sponge seal 69Y are positioned right above the right-side wall surface 61Ya. The sponge seal 69Y fills a gap between the toner container 32Y and the toner tank 61Y by being compressed by the toner container 32Y and the toner tank 61Y.

An external circumferential surface 61Yc having a gently slanted sliding surface of the toner carrying tube 63Y is formed at the left side of the right-side wall surface 61Ya by being connected to the right-side wall surface 61Ya. The toners supplied from the toner container 32Y via the toner input opening 69Ya are loosened by hitting the shaft of the toner stirring member 65Y and the flexible member 65Ya disposed above the right-side wall surface 61Ya.

Further, the toners slide down the right-side wall surface 61Ya and the external circumferential surface 61Yc while the toners are loosened by hitting the right-side wall surface 61Ya and the external circumferential surface 61Yc, and flow into the toner carrying upstream side of the toner carrying screw 62Y (the slanted left-end side). As described above, in the second embodiment of the present invention, the toner carrying route can be long in a relatively small space, and the plural toner hitting positions can be formed. With this, the toner stirring ability can be increased.

As shown in FIGS. 5, 7, and 8, the upper half part of the permanent magnet 68Y is obliquely wound around the toner carrying tube 63Y. With this, while maintaining the long toner carrying route, the amount of the toner carrier C to be sustained at a position facing the upper part of the toner carrying screw 62Y can be relatively large. That is, the amount of the toner carrier C attracted by the permanent magnet 68Y at the position above the toner dropping route 64Y can be relatively large and the toners to be dropped into the toner dropping route can be small. In addition, the lower part of the permanent magnet 68Y is near the toner dropping route 64Y on the external circumferential surface of the toner carrying tube 63Y. With this, the toners remaining in the toner carrying tube 63Y at the position near the toner dropping opening 64Ya are likely to stay at the position without dropping from the toner dropping opening 64Ya by the toner own weight.

In addition, in the second embodiment of the present invention, as shown in FIG. 5, in the toner carrying tube 63Y, it is determined that a toner carrying route length W from one opening end connecting to the toner tank 61Y to one end of the toner dropping route 64Y is 1.5 times or more a screw pitch D ($W \geqq 1.5 \times D$).

In the second embodiment of the present invention, the inventor of the present invention has performed a first experiment so as to surely obtain the above effect.

In the first experiment, two toner supplying devices 60Y were used. In the first toner supplying device 60Y, the permanent magnet 68Y and the toner carrier C were used, and in the second toner supplying device 60Y, the permanent magnet 68Y and the toner carrier C were not used. Then the amount of toners dropped from the toner dropping opening 64Ya to the developing device 5Y was measured when toners having high liquidity were carried by the toner carrying screw 62Y and the toner carrying tube 63Y.

In the first experiment, in the toners, a polyester based resin was used as a base resin and the grain diameter of the toners was 6 to 12.5 μm. In addition, 235 grams of the toners were supplied in the toner container 32Y and the toner container 32Y was shaken a few times up and down to increase the liquidity of the toners. Then the toner container 32Y was attached to the image forming apparatus main body 100.

In the results of the first experiment, in the first toner supplying device 60Y, only 0.0 to 0.5 grams of the toners were dropped into the developing device 5Y via the toner dropping opening 64Ya from 235 grams of the toners in the toner container 32Y. In the second toner supplying device 60Y, approximately 10 grams of the toners were dropped into the developing device 5Y via the toner dropping opening 64Ya from 235 grams of the toners in the toner container 32Y. In addition, in the first toner supplying device 60Y, since the amount of the toners dropped into the developing device 5Y was small, the toner concentration in the developer G in the developing device 5Y was not greatly varied. However, in the second toner supplying device 60Y, since the amount of the toners dropped into the developing device 5Y was large, the toner concentration in the developer G in the developing device 5Y was greatly varied.

Further, in the second embodiment of the present invention, the inventor of the present invention has performed a second experiment so as to assure obtaining the above effect.

In the second experiment, in the toner supplying device 60Y, a relationship between the ratio (W/D) and a period was measured. The ratio (W/D) is a ratio of the toner carrying route length W in the toner carrying tube 63Y to the screw pitch D of the toner carrying screw 62Y. The period is time required for the toners to start to drop from the toner carrying tube 63Y to the toner dropping route 64Y after stopping the toner carrying screw 62Y.

In the second experiment, intermittent operations were repeated in which toners were stopped being supplied for 0.1 seconds after supplying the toners to the developing device 5Y for 0.2 seconds. The period was converted into the number of recording media (sheets) of a solid image of A3 size (297 mm×420 mm) to be printed.

Figure 9:
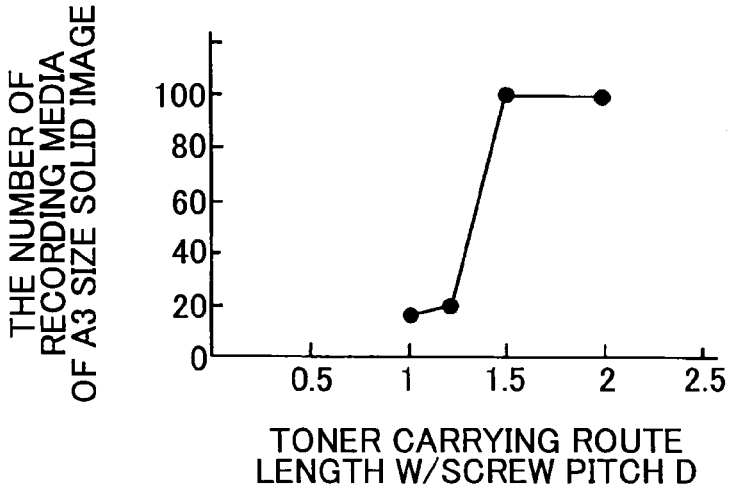
FIG. 9 is a graph showing a result of a second experiment according to the second embodiment of the present invention.

FIG. 9 is a graph showing a result of the second experiment according to the second embodiment of the present invention. In FIG. 9, the horizontal line shows the ratio (W/D) of the toner carrying route length W in the toner carrying tube 63Y to the screw pitch D of the toner carrying screw 62Y, and the vertical line shows the number of recording media (sheets) of an solid image of A3 size, and in FIG. 9, the maximum number is determined to be 100 sheets.

As shown in FIG. 9, when the ratio (W/D) becomes 1 or more, the period of time required for the toners to start to drop from the toner carrying tube 63Y to the toner dropping route 64Y after stopping the toner carrying screw 62Y becomes long. When the ratio (W/D) becomes 1.5 or more, the period becomes a constant value. Therefore, it is preferable that the ratio (W/D) be 1.5 or more. That is, when the period is long, the toners are hardly dropped from the toner carrying tube 63Y to the toner dropping route 64Y.

As described above, in the second embodiment of the present invention, since the permanent magnet 68Y and the toner carrier C control the amount of the toners to be dropped from the toner carrying screw 62Y and the toner carrying tube 63Y to the toner dropping route 64Y, the variation of the amount of the toners to be supplied to the developing device 5Y can be prevented.

In the first and second embodiments of the present invention, the toner dropping route 64Y is vertically formed and the toners are dropped by the toner own weight into the developing device 5Y. However, the toner dropping route 64Y can be formed obliquely to the developing device 5Y and the toners can drop by the toner own weight into the developing device 5Y. That is, in the first and second embodiments of the present invention, the dropping direction of the toners into the developing device 5Y by the toner own weight includes the direction oblique to the developing device 5Y.

In addition, in the first and second embodiments of the present invention, the toner containers 32Y, 32M, 32C, and 32K only contain the corresponding toners. However, the toner containers 32Y, 32M, 32C, and 32K can contain corresponding two-component developers formed of toners and a toner carrier. In this case, the same effects as those in the embodiments of the present invention can be obtained.

In addition, in the first and second embodiments of the present invention, a part or all of the corresponding image forming sections 6Y, 6M, 6C, and 6K can be included in the corresponding process cartridges. In this case, the same effects as those in the first and second embodiments of the present invention can be obtained.

In addition, in FIGS. 4 and 5, the toner tank 61Y, the toner carrying screw 62Y, the toner carrying tube 63Y, and the toner dropping route 64Y of the toner supplying device 60Y are formed in a -shaped structure viewed from the direction perpendicular to the plane of the paper of FIGS. 4 and 5. In addition, in FIG. 1, the toner supplying device 60Y is at the left upper position of the image forming section 6Y (process cartridge), and the toner container 32Y is also at the left upper position of the image forming section 6Y.

With this, in a tandem type image forming apparatus in which plural image forming sections 6Y, 6M, 6C, and 6K are arrayed in parallel, when the image forming section 6Y (process cartridge) is attached to or detached from the image forming apparatus main body 100, the image forming section 6Y and the toner supplying device 60Y do not interfere with each other. Therefore, in the image forming apparatus main body 100, the length in the vertical direction from the toner containers 32Y, 32M, 32C, and 32K to the image forming sections 6Y, 6M, 6C, and 6K can be shortened, and the variation of the amount of toners to be supplied to the corresponding developing devices 5Y, 5M, 5C, and 5K can be prevented.

According to the first and second embodiments of the present invention, as described above, the control unit controls the amount of the toners to be dropped into the toner dropping route 64Y right after the image forming apparatus stops operations. In addition, the developing device 5Y can be integrated with the process cartridge 6Y which is detachable from the image forming apparatus main body 100. In addition, the image forming apparatus includes plural units in which each of the toner containers 32Y, 32M, 32C, and 32K, each of the corresponding toner supplying devices 60Y, 60M, 60C, and 60K, and each of the corresponding process cartridges 6Y, 6M, 6C, and 6K are integrated. In addition, the toner tank 61Y, the toner carrying screw 62Y, the toner carrying tube 63Y, and the toner dropping route 64Y of the toner supplying device 60Y are formed in an N-shaped or an inverted N-shaped structure viewed from the direction perpendicular to the toner carrying route. In addition, a second toner container and a part of a toner carrying route from the second toner container to a second process cartridge is disposed above a first process cartridge adjacent to the second process cartridge.

In the first and second embodiments of the present invention, in the image forming apparatus, the toner supplying device is mainly described.

In third through sixth embodiments of the present invention, in an image forming apparatus, a drive coupling for rotating a toner container main body of a toner container and the toner container are mainly described.

Third Embodiment

Next, referring to the drawings, a third embodiment of the present invention is described. In the third embodiment of the present invention, in some cases, a reference number (sign) of an element is different from that in the first and second embodiments of the present invention even if the function of the element is the same as that in the first and second embodiments of the present invention. In addition, in the third embodiment of the present invention, in some cases, a reference number (sign) of an element is the same as that in the first and second embodiments of the present invention even if the function of the element is slightly different from that in the first and second embodiments of the present invention.

Figure 10:
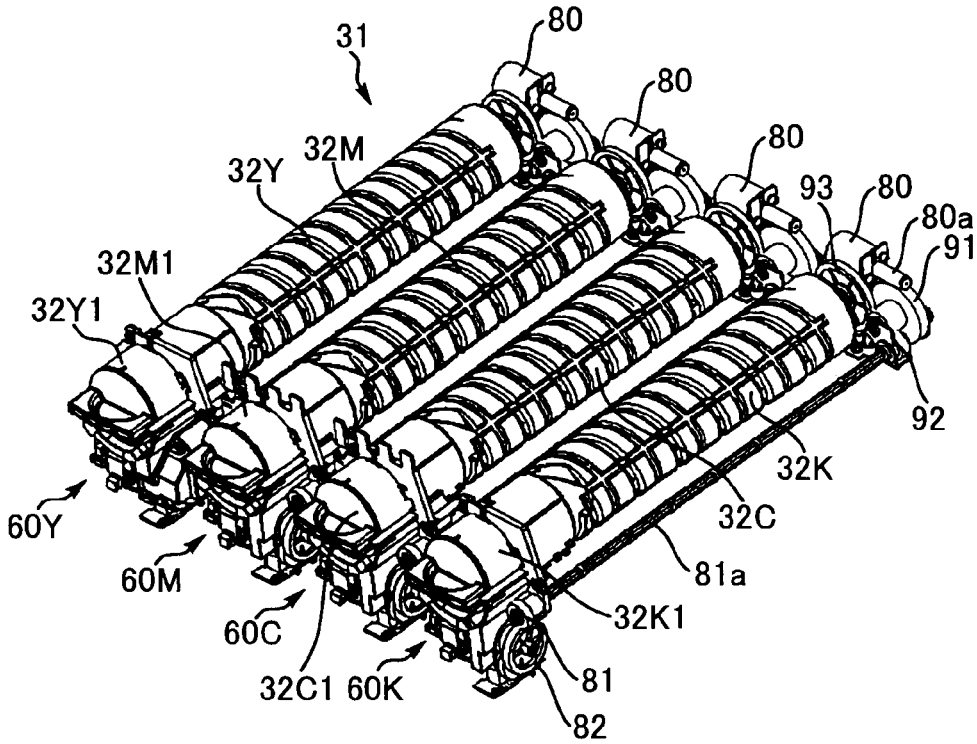
FIG. 10 is a perspective view of the toner containers and the toner supplying devices shown in FIG. 1 according to a third embodiment of the present invention.
Figure 11:
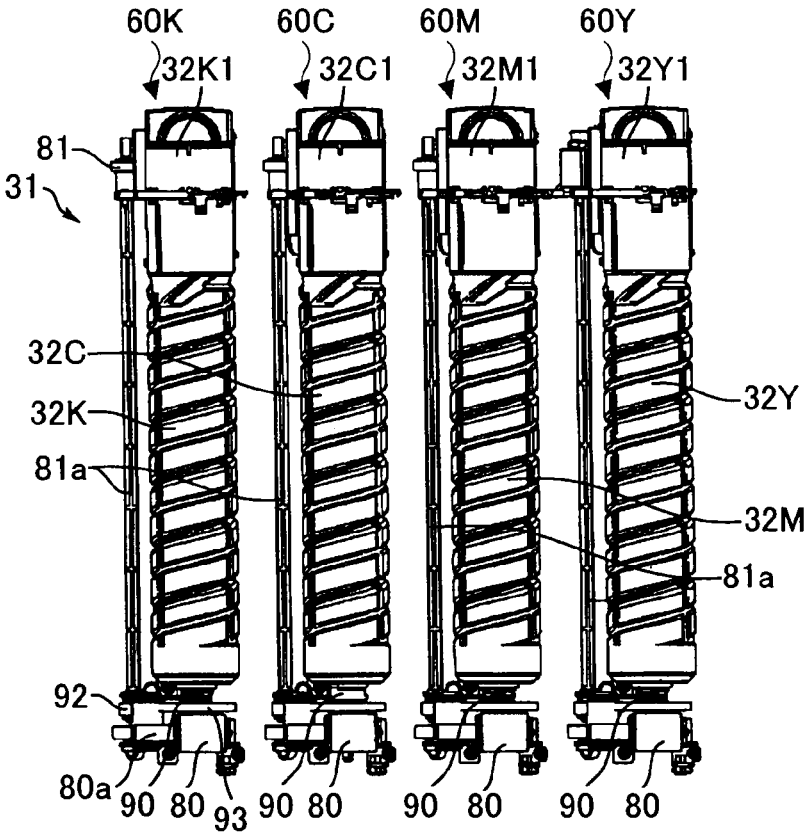
FIG. 11 is a plan view of the toner containers and the toner supplying devices shown in FIG. 1 according to the third embodiment of the present invention.
Figure 12:
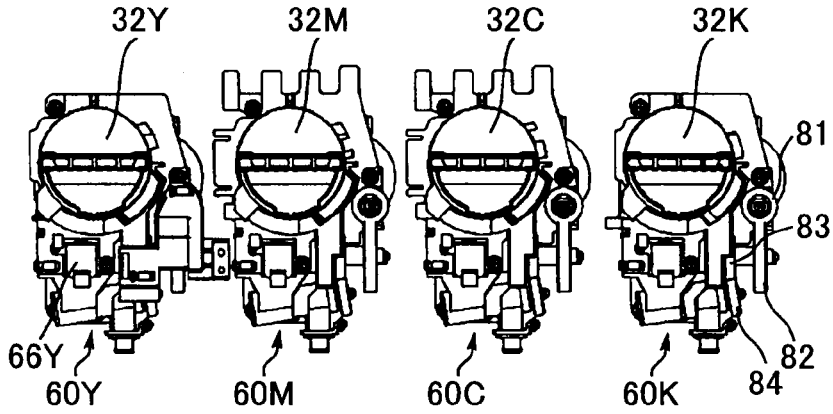
FIG. 12 is a front view of the toner containers and the toner supplying devices shown FIG. 1 according to the third embodiment of the present invention.
Figure 13:
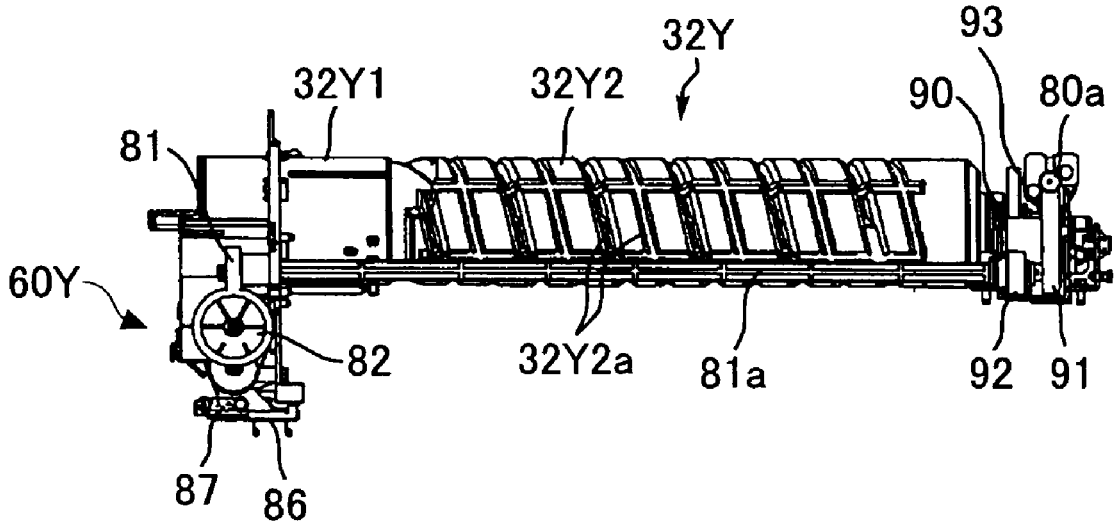
FIG. 13 is a side view of the toner container and the toner supplying device shown in FIG. 10.
Figure 14A:
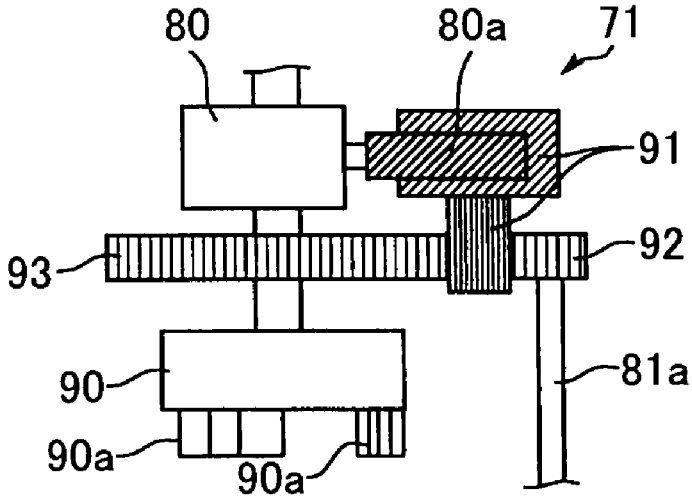
FIG. 14A is a driving mechanism for driving the toner container main body, a toner stirring member and a toner carrying screw according to the third embodiment of the present invention.
Figure 14B:
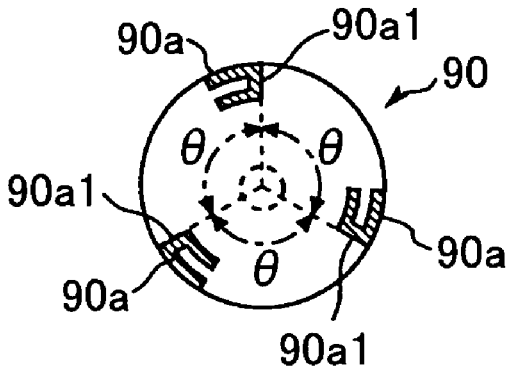
FIG. 14B is a schematic diagram showing a drive coupling shown in FIG. 14A.
Figure 15:
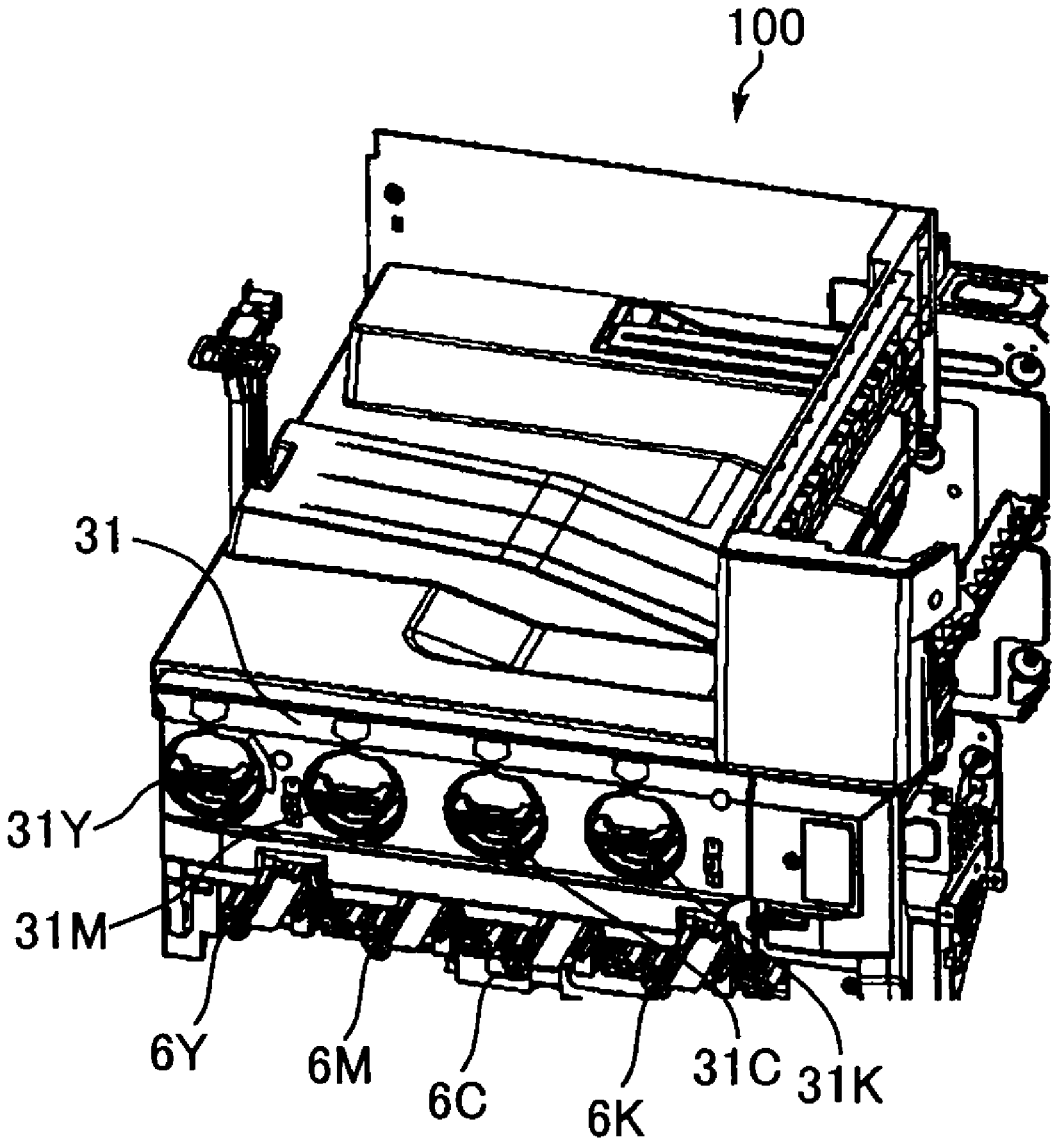
FIG. 15 is a perspective view of a part of the image forming apparatus main body according to the third embodiment of the present invention.
Figure 16:
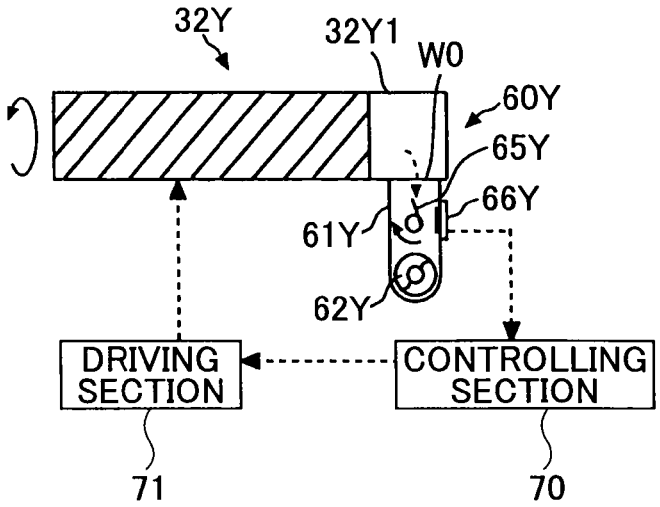
FIG. 16 is a schematic diagram showing a part of the image forming apparatus main body including the toner container and the toner supplying device.
Figure 17:
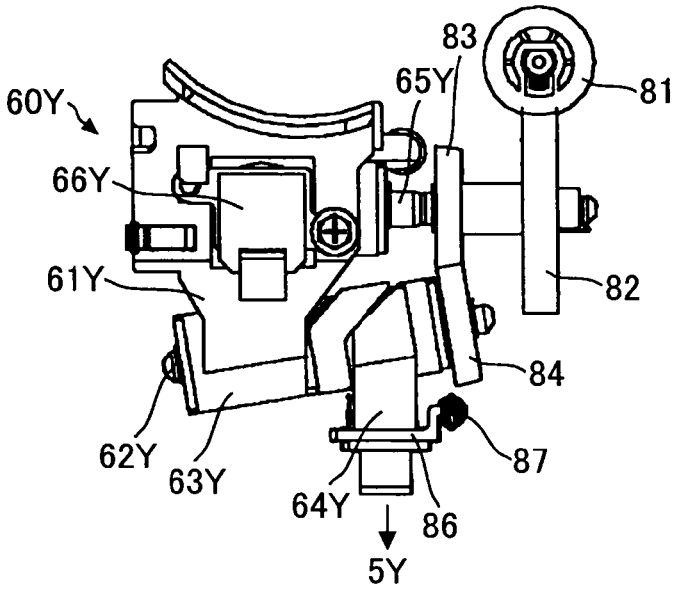
FIG. 17 is an external view of the toner supplying device according to the third embodiment of the present invention.
Figure 18:
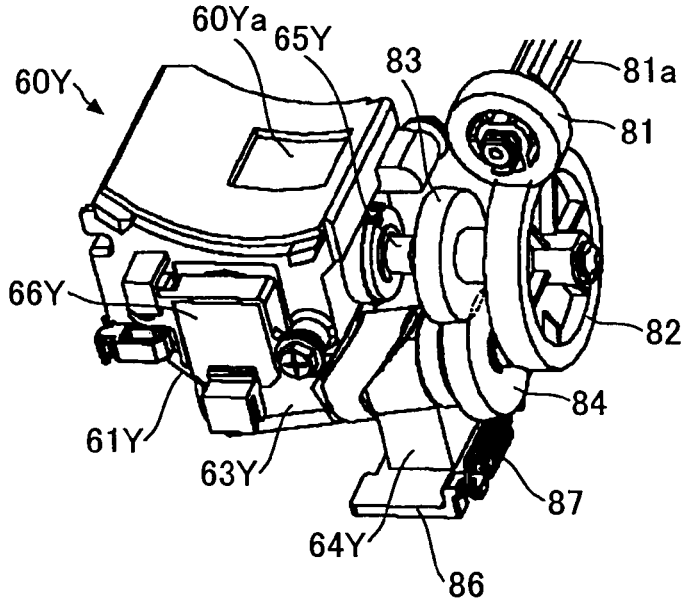
FIG. 18 is a perspective view of the toner supplying device according to the third embodiment of the present invention.

FIG. 10 is a perspective view of the toner containers 32Y, 32M, 32C, and 32K, and the toner supplying devices 60Y, 60M, 60C, and 60K shown in FIG. 1 according to the third embodiment of the present invention. FIG. 11 is a plan view of the toner containers 32Y, 32M, 32C, and 32K, and the toner supplying devices 60Y, 60M, 60C, and 60K shown in FIG. 1 according to the third embodiment of the present invention. FIG. 12 is a front view of the toner containers 32Y, 32M, 32C, and 32K, and the toner supplying devices 60Y, 60M, 60C, and 60K shown in FIG. 1 according to the third embodiment of the present invention. FIG. 13 is a side view of the toner container 32Y and the toner supplying device 60Y. FIG. 14A is a driving mechanism for driving the toner container main body 32Y2, the toner stirring member 65Y, and the toner carrying screw 62Y according to the third embodiment of the present invention. FIG. 14B is a schematic diagram showing a drive coupling 90 shown in FIG. 14A. FIG. 15 is a perspective view of a part of the image forming apparatus main body 100 according to the third embodiment of the present invention. FIG. 16 is a schematic diagram showing a part of the image forming apparatus main body 100 including the toner container 32Y and the toner supplying device 60Y. FIG. 17 is an external view of the toner supplying device 60Y according to the third embodiment of the present invention. FIG. 18 is a perspective view of the toner supplying device 60Y according to the third embodiment of the present invention.

Referring to FIGS. 10 through 16, the toner supplying devices 60Y, 60M, 60C, and 60K are described. As shown in FIG. 16, when the toner container 32Y is attached to the toner container storing section 31 of the image forming apparatus main body 100 (see FIG. 1), a shutter of the toner container 32Y is moved and a toner outlet W0 (toner discharging opening) is opened. With this, toners contained in the toner container 32Y are supplied into the toner tank 61Y of the toner supplying device 60Y.

The toner container 32Y is an approximately cylinder-shaped toner bottle, and includes a spiral protrusion on the internal circumferential surface of the toner container 32Y. When the spiral protrusion is viewed from the outside, a spiral groove is taken. When the toner container 32Y is rotated in the arrow direction by a driving section 71, the spiral protrusion discharges the toners from the toner outlet W0. As shown in FIGS. 10 through 14B, the driving section 71 includes a driving motor 80, a drive coupling 90, and gears 91, 92, and 93. That is, when the toner container 32Y is suitably rotated by the driving section 71, the toners are suitably supplied to the toner tank 61Y. When the service life of each of the toner containers 32Y, 32M, 32C, and 32K has passed, that is, when almost all toners in each of the toner containers 32Y, 32M, 32C, and 32K has been consumed, an old one is replaced with a new one.

As described in the first embodiment of the present invention, the toner supplying device 60Y includes the toner tank 61Y, the toner carrying screw 62Y, the toner carrying tube 63Y, the toner dropping route 64Y, the toner stirring member 65Y, and the toner end sensor 66Y. In addition, in the third embodiment of the present invention, the toner supplying device 60Y further includes the driving motor 80 (see FIG. 10), the drive coupling 90 (see FIG. 11), the gears 81 through 84 (see FIG. 12), the gears 91 through 93 (see FIG. 10), a driving force transmission shaft 81*a* (see FIG. 14A), and the shutter 86 (see FIG. 17).

In FIGS. 10 through 14B, each of the toner supplying devices 60Y, 60M, 60C, and 60K provides the drive coupling 90 at the rear part. The drive coupling 90 of the toner supplying device 60Y engages with engaging members 32Y2*b* (see FIG. 20) of the toner container 32Y. A driving force of the driving motor 80 is transmitted to the drive coupling 90 via a motor gear 80*a*, a two speed gear 91, and a driven gear 93, and a container main body 32Y2 of the toner container 32Y is rotated in a predetermined direction by the drive coupling 90.

The driving motor 80 is a DC motor whose output power and size are almost the same as those of a motor which is generally used to build a plastic car model, and its input voltage is approximately 24 V. The driving motor 80 rotates the toner container main body 32Y2 from the bottom section of the toner container main body 32Y2, and also rotates a gear 92 having the driving force transmission shaft 81*a* which extends from near the bottom section of the toner container main body 32Y2 to a cap 32Y1 of the head of the toner container main body 32Y2.

The driving force transmitted from the driving force transmission shaft 81*a* drives the toner stirring member 65Y in the toner tank 61Y and the toner carrying screw 62Y in the toner carrying tube 63Y via the bevel gears 81 and 82 having corresponding large twisting angles and the skew gears 83 and 84 (see FIG. 17).

By the above complex driving force transmission mechanism and the three objects to be driven (the toner container main body 32Y2, the toner stirring member 65Y, and the toner carrying screw 62Y) whose loads on the driving mechanism are large due to the corresponding rotation, the stirring, and the rotation; the rotation of the toner container main body 32Y2 is likely to fluctuate.

In order to avoid the rotation fluctuation of the toner container main body 32Y2, as shown in FIG. 14B, the drive coupling 90 provides three claw members 90*a*. The three claw members 90*a* are disposed in the 120-degree distribution angle with the rotational axle center of the drive coupling 90 as the reference. A contacting surface 90*a*1 of the claw member 90*a* engages a contacting surface R (see FIG. 25) of the engaging member 32Y2*b* of the toner container 32Y. With this, the rotational force from the drive coupling 90 is transmitted to the engaging members 32Y2*b* of the toner container 32Y.

The gear 92 engaged with the two speed gear 91 transmits the driving force to the bevel gear 81 disposed in the front of the toner supplying device 60Y via the driving force transmission shaft 81*a*. The driving force transmitted to the bevel gear 81 rotates the toner carrying screw 62Y and the toner stirring member 65Y via the gears 82 through 83 (see FIG. 17).

In FIG. 15, when a cover (not shown) in the front of the image forming apparatus main body 100 is opened, the toner container storing sections 31Y, 31M, 31C, and 31K appear, and the toner containers 32Y, 32M, 32C, and 32K can be detached from the image forming apparatus main body 100.

In the present embodiment, the shapes of the openings into which the corresponding toner supplying device 60Y, 60M, 60C, and 60K are inserted are different from each other.

Figure 19:
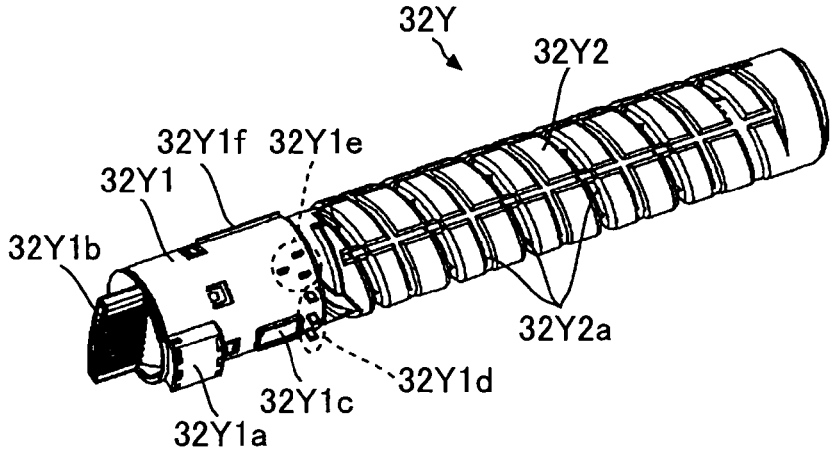
FIG. 19 is a perspective view of the toner container.

Specifically, for example, the toner supplying device 60Y provides a first guide groove (not shown) which engages a guide rib 32Y1*f* formed in the cap 32Y1 of the toner container 32Y and a second guide groove (not shown) which engages protrusion members 32Y1*d* and 32Y1*e* formed in the cap 32Y1 of the toner container 32Y (see FIG. 19). The shapes of the second guide grooves are different among colors. With this, error attachment of a toner container to a different toner supplying device is prevented.

In addition, the toner containers 32Y, 32M, 32C, and 32K are detachably arrayed from the image forming apparatus main body 100. An antenna board (not shown) is disposed in a holding member which holds the toner container storing section 31 in the image forming apparatus main body 100. Specifically, in the antenna board, four antennas for communicating with electronic boards of the corresponding toner containers 32Y, 32M, 32C, and 32K face the electronic boards in the same plane. For example, as shown in FIG. 19, an electronic board 32Y1*c* is in the cap of the toner container 32Y.

Information is transmitted and received between the antenna board of the image forming apparatus main body 100 and the electronic board 32Y1*c* of the toner container 32Y. The information includes a serial number of a toner container, the number of reuse times of a toner container, a remaining amount of toners in a toner container, a lot number of a toner container, and color of toners in a toner container; and a usage history of the image forming apparatus.

Referring to FIGS. 4, 16, and 17, the structure of the toner supplying device 60Y is described.

The toner supplying device 60Y includes the toner tank 61Y, the toner carrying screw 62Y, the toner carrying tube 63Y, the toner dropping route 64Y, the toner stirring member 65Y, the toner end sensor 66Y, the gears 81 through 84, and the shutter 86.

The toner tank 61Y is disposed under the toner outlet W0 of the cap 32Y1 in the toner container 32 and stores the toners discharged from the toner outlet WO of the cap 32Y1 in the toner container 32Y. The bottom part of the toner tank 61Y is connected to the upstream side of the toner carrying screw 62Y and the toner carrying tube 63Y.

The toner end sensor 66Y is disposed on a wall surface of the toner tank 61Y at a position having a predetermined height from the bottom surface of the toner tank 61Y. The toner end sensor 66Y detects a signal when the amount of the toners stored in the toner tank 61Y becomes a value less than a predetermined value. As the toner end sensor 66Y, a piezoelectric sensor can be used. In FIG. 16, when the toner end sensor 66Y detects a signal that the amount of the toners stored in the toner tank 61Y has become a value less than a predetermined value, the signal is sent to the controlling section 70. The controlling section 70 controls the driving section 71 to rotate the toner container 32Y for a predetermined period so as to supply toners to the toner tank 61Y. The driving section 71 includes the driving motor 80, the gears 91 through 93, and the drive coupling 90.

When the toner end sensor 66Y continues to detect the signal even if the driving section 71 repeats rotating the toner tank 32Y, the controlling section 70 determines that the toners do not remain in the toner container 32Y. Then the controlling section 70 displays a message which instructs to replace the existing toner container 32Y with a new one on a displaying section (not shown) of the image forming apparatus main body 100.

The toner stirring member 65Y is disposed at an inner center position of the toner tank 61Y near the toner end sensor 66Y for preventing the toners stored in the toner tank 61Y from being condensed. The toner stirring member 65Y is formed by a flexible member 65Ya at a shaft (not shown). When the shaft is rotated clockwise (see FIG. 16), the toner stirring member 65Y stirs the toners in the toner tank 61Y.

In addition, since the tip of the flexible member 65Ya of the toner stirring member 65Y contacts the detecting surface of the toner end sensor 66Y with a rotational cycle of the toner stirring member 65Y, lowering the detecting accuracy due to adhering toners onto the detecting surface of the toner end sensor 66Y is prevented.

In FIG. 17, the bevel gear 82 having a twisting angle of 45 degrees is attached to one end of the shaft of the toner stirring member 65Y, and a driving force is transmitted to the toner stirring member 65Y via the bevel gear 81 having a twisting angle of 45 degrees engaged with the bevel gear 82. In FIG. 17, tooth traces of the bevel gears 81 and 82 are omitted.

As described in FIG. 4, the toner carrying screw 62Y and the toner carrying tube 63Y carry the toners stored in the toner tank 61Y in the obliquely upward direction (the arrow direction). Specifically, the toner carrying screw 62Y and the toner carrying tube 63Y linearly carry the toners from the bottom part (the lowest part) of the toner tank 61Y to a position above the developing device 5Y (the toner dropping opening 64Ya of the toner dropping route 64Y). The toners reaching the toner dropping opening 64Ya are supplied to the developer container 54Y (see FIG. 2) of the developing device 5 by the toner own weight via the toner dropping route 64Y.

The toner carrying screw 62Y carries the toners by being rotated in a predetermined direction and is in the toner carrying tube 63Y. The toner carrying screw 62Y and the toner carrying tube 63Y form a toner carrying section.

The toner carrying screw 62Y is a screw member in which a helicoid is spirally formed on a shaft and is rotatably sustained in the toner carrying tube 63Y via bearings (not shown). In addition, the skew gear 84 is attached to one end of the toner carrying screw 62Y, and a driving force is transmitted to the toner carrying screw 62Y via the skew gear 83 attached to the shaft of the toner stirring member 65Y which skew gear 83 is engaged with the skew gear 84.

The upstream side of the toner carrying tube 63Y is connected to the toner tank 61Y and the downstream side of the toner carrying tube 63Y is connected to the toner dropping route 64Y via the toner dropping opening 64Ya. The toner carrying tube 63Y is formed of a resin material. The gap between the external diameter of the toner carrying screw 62Y and the inner wall of the toner carrying tube 63Y is approximately 0.1 to 0.2 mm. With this, the toners are smoothly carried in the obliquely upward direction against the gravitational force by the toner carrying screw 62Y and the toner carrying tube 63Y.

As described above, in the third embodiment of the present invention, the toners stored in the toner tank 61Y are carried in the obliquely upward direction by the toner carrying screw 62Y and the toner carrying tube 63Y, and the carried toners are supplied to the developing device 5Y by the toner own weight via the toner dropping route 64Y. With this, when the rotation of the toner carrying screw 62Y is stopped and the toner supply to the developing device 5Y is stopped, the toners remaining in the toner carrying tube 63Y are hardly dropped into the developing device 5Y via the toner dropping route 64Y.

Specifically, the toners remaining at a position apart from the toner dropping opening 64Ya in the toner carrying tube 63Y slide toward the toner tank 61Y along the oblique toner carrying tube 63Y or stay at the position. In addition, the toners remaining at a position near the toner dropping opening 64Ya in the toner carrying tube 63Y are not greatly dropped from the toner dropping opening 64Ya by the toner own weight even if a great shock is given to the apparatus, and the toners slide toward the toner tank 61Y along the oblique toner carrying tube 63Y or stay at the position.

Therefore, even if the rotation and non-rotation of the toner carrying screw 62Y are repeated, the amount of toners to be supplied to the developing device 5Y can be controlled at high accuracy; that is, the toners can be stably supplied to the developing device 5Y. Consequently, the variation of the toner concentration in the developer G can be prevented. That is, the image density of an output image can be prevented from being high, the toners can be prevented from being scattered, and the background image can be prevented from being degraded.

As described by using FIG. 4, in order to surely obtain the above effect, it is preferable that the inclination angle $\alpha$ of the toner carrying screw 62Y and the toner carrying tube 63Y for the horizontal direction be 5 or more degrees ($\alpha \geqq 5°$) However, when the inclination angle $\alpha$ becomes too large, the toner carrying ability by the toner carrying screw 62Y and the toner carrying tube 63Y is lowered and the height of the apparatus becomes great. Therefore, in the third embodiment of the present invention, the inclination angle $\alpha$ is approximately 10 degrees.

In addition, as shown in FIGS. 17 and 18, the shutter 86 is attached to the toner dropping route 64Y, and the shutter 86 is opened or closed when the developing device 5Y is attached to or detached from the image forming apparatus main body 100. Specifically, when the developing device 5Y is attached to the image forming apparatus main body 100, the shutter 86 moves to open the toner dropping route 64Y by being pushed by the developing device 5Y against a force of a spring 87. When the developing device 5Y is detached from the image forming apparatus main body 100, the shutter 86 moves to close the toner dropping route 64Y by the force of the spring 87. With this, when the developing device 5Y is detached from the image forming apparatus main body 100, the toners cannot be scattered in the image forming apparatus main body 100 from the toner dropping route 64Y.

Next, referring to FIGS. 19 through 25, the toner container 32Y is described in detail.

Figure 20:
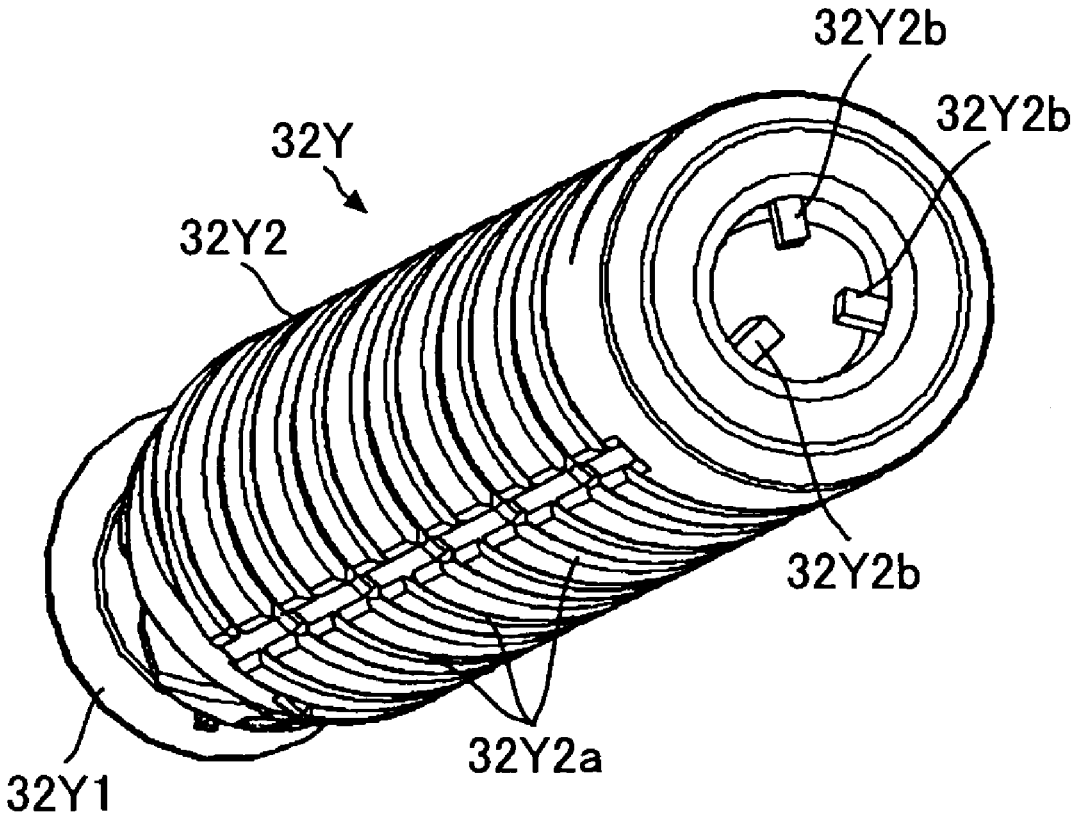
FIG. 20 is a perspective view of the toner container taken from the bottom of the toner container.
Figure 21:
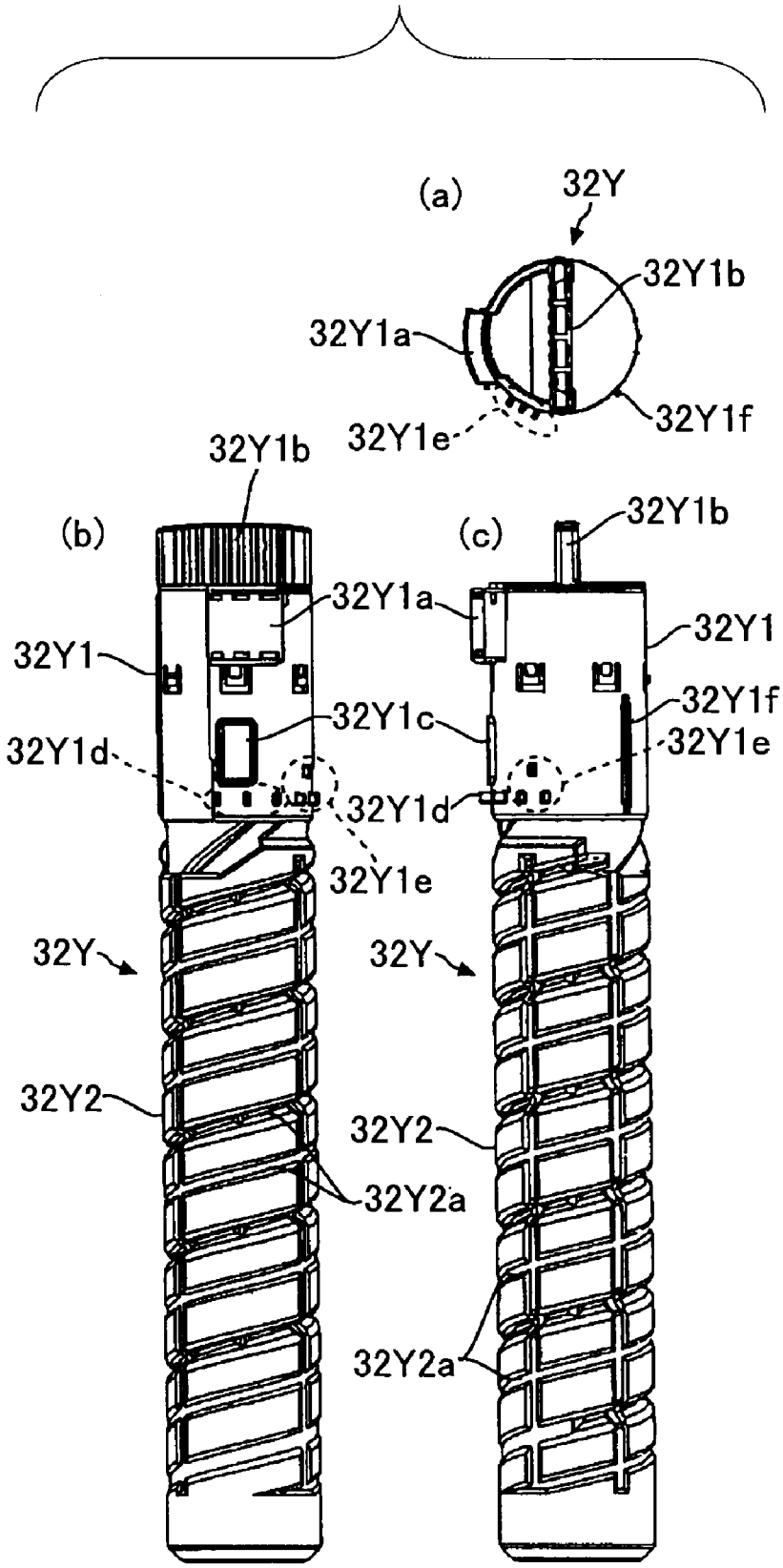
FIG. 21 is a diagram showing three views of the toner container.
Figure 22:
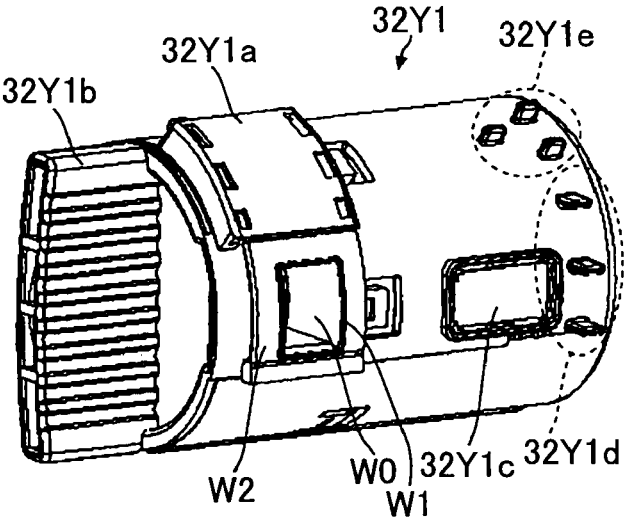
FIG. 22 is a perspective view of a cap of the toner container.
Figure 23:
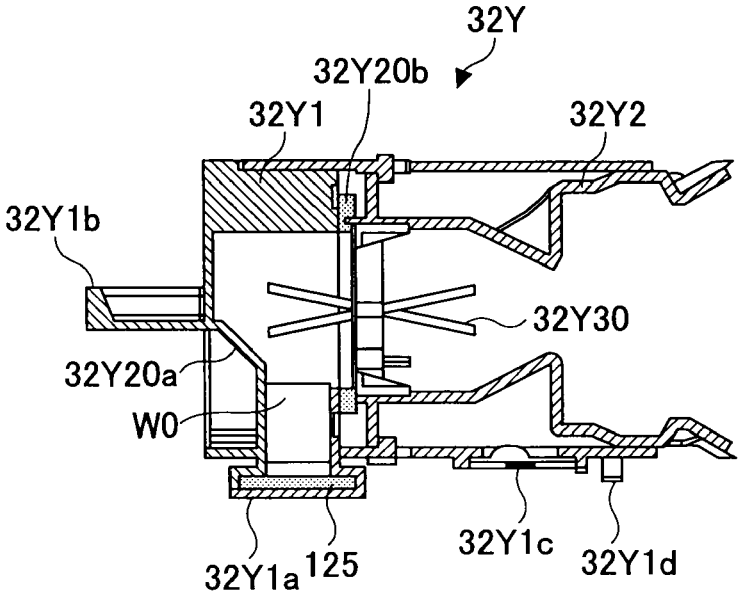
FIG. 23 is a schematic diagram showing a head part of the toner container.
Figure 24:
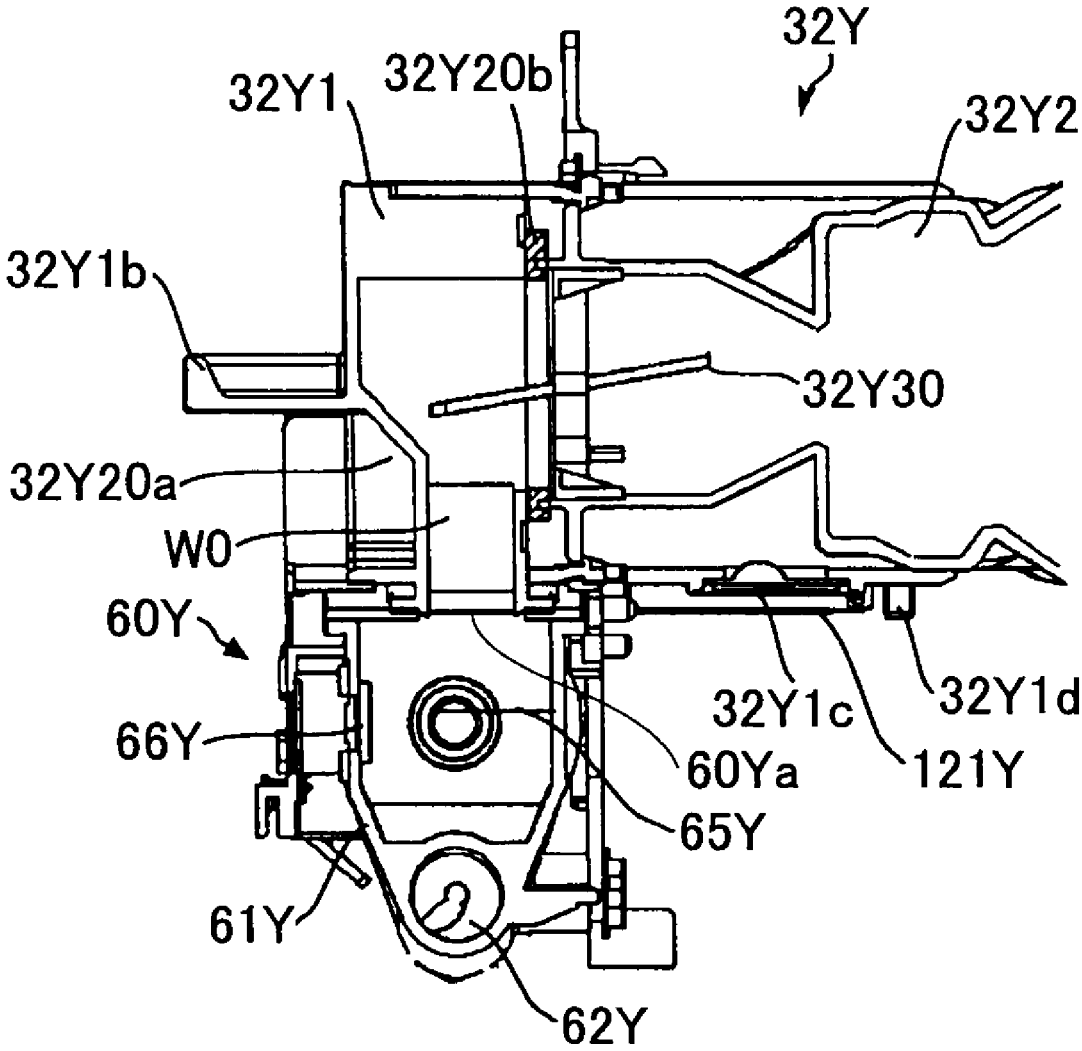
FIG. 24 is a schematic diagram showing the head part of the toner container attached to the toner supplying device.
Figure 25:
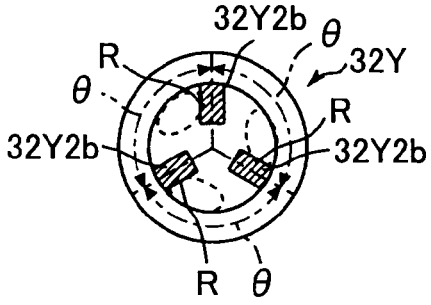
FIG. 25 is a bottom view of the toner container.

FIG. 19 is a perspective view of the toner container 32Y. FIG. 20 is a perspective view of the toner container 32Y taken from the bottom of the toner container 32Y. FIG. 21 is a diagram showing three views of the toner container 32Y. FIG. 22 is a perspective view of the cap 32Y1 of the toner container 32Y. FIG. 23 is a schematic diagram showing a head part of the toner container 32Y. FIG. 24 is a schematic diagram showing the head part of the toner container 32Y attached to the toner supplying device 60Y. FIG. 25 is a bottom view of the toner container 32Y.

As shown in FIG. 19, the toner container 32Y has a cylindrical shape and includes the cap 32Y1 and the toner container main body 32Y2.

The toner container main body 32Y2 has an opening at the head part and the opening is connected to the inside of the cap 32Y1. A spiral protrusion is formed on the inner wall of the toner container main body 32Y2. The toner container main body 32Y2 is rotated in a predetermined direction by receiving a driving force from the drive coupling 90, and toners in the toner container 32Y are carried to the cap 32Y1. The drive coupling 90 (see FIG. 11) is engaged with the engaging members 32Y2*b* (see FIG. 20) formed on the bottom of the toner container 32Y.

The toners discharged from the opening of the toner container main body 32Y2 are output from the toner outlet W0 formed at a circumferential surface of the cap 32Y1 and are supplied to the toner tank 61Y of the toner supplying device 60Y (see FIG. 24).

As shown in FIG. 23, a scraper 32Y30 is disposed at the opening of the toner container main body 32Y2. The scraper 32Y30 is rotated together with the toner container main body 32Y2 and effectively moves the toners near the opening of the cap 32Y1.

As shown in FIGS. 20 and 25, in the third embodiment of the present invention, the engaging members 32Y2*b* formed on the bottom section of the toner container main body 32Y2 are disposed in a distribution angle θ other than 90 degrees and 180 degrees with the rotational axle center of the toner container main body 32Y2 as the reference. The engaging members 32Y2*b* are engaged with the claw members 90*a* of the drive coupling 90 (see FIG. 14B). Specifically, in the third embodiment of the present invention, the distribution angle θ is 120 degrees.

When the distribution angle θ is 120 degrees, compared with the distribution angle θ being 90 or 180 degrees, the load fluctuation to be applied to the drive coupling 90 (the driving motor 80) can be lowered, and the variation of the amount of toners to be supplied to the developing device 5Y can be decreased.

Figure 26:
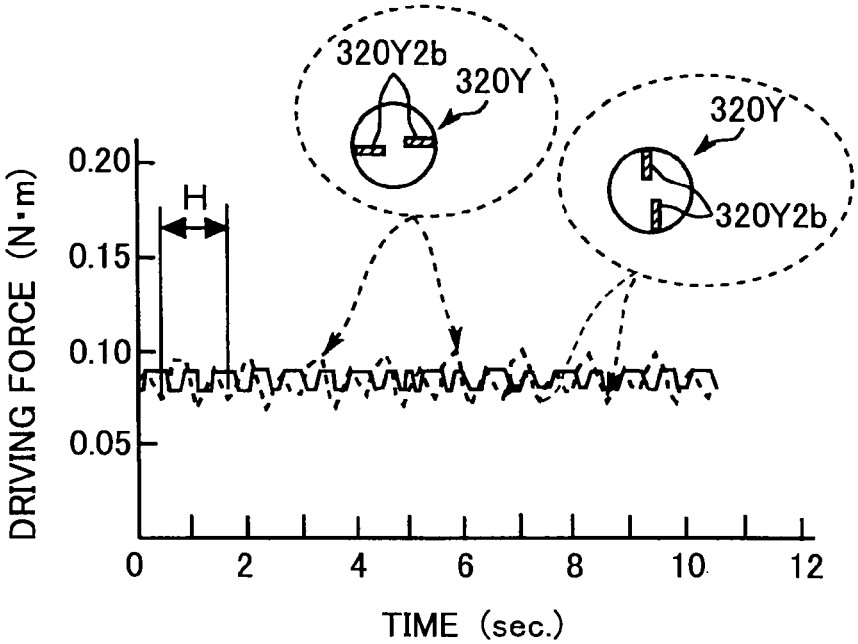
FIG. 26 is a graph showing a result of an experiment according to the third embodiment of the present invention.

The inventor of the present invention has performed an experiment so as to obtain the above effect. FIG. 26 is a graph showing the results of the experiment.

In FIG. 26, the horizontal line shows time (second) and the vertical line shows driving torque of the drive coupling 90. In FIG. 26, the continuous line shows the variation of the driving torque of the drive coupling 90 when the distribution angle θ is 120 degrees, and the broken line shows the variation of the driving torque of the drive coupling 90 when the distribution angle θ is 180 degrees (in a conventional device). That is, in case of the distribution angle θ being 120 degrees, the toner container main body 32Y2 provides the three engaging members 32Y2*b* and the drive coupling 90 provides the three claw members 90*a*, and in case of the distribution angle θ being 180 degrees, the toner container main body 32Y2 provides the two engaging members 32Y2*b* and the drive coupling 90 provides the two claw members 90*a*.

As shown in FIG. 26, when the distribution angle is 180 degrees, since the two claw members 90*a* of the drive coupling 90 repeat the vertical status and the horizontal status at the same timing, the load fluctuation become large when the toner container main body 32Y2 is driven. Consequently, the load on the driving motor 80 is greatly varied and the variation of the amount of toners supplied to the developing device 5Y by the toner carrying screw 62Y becomes large.

In FIG. 26, in a case where an engaging section 320Y including two engaging members 320Y2*b* is referred to, when the two engaging members 320Y2*b* are in the horizontal status, the driving force of the drive coupling 90 becomes a maximum value, and when the two engaging members 320Y2*b* are in the vertical status, the driving force of the drive coupling 90 becomes a minimum value. The maximum value and the minimum value repeat in the cycle H. In this case, the amount of supplied toners and the variation of the amount of supplied toners were 0.18 grams/s±30 to 48%.

In the third embodiment of the present invention, since the distribution angle θ is 120 degrees and the three engaging members 32Y2*b* (the three claw members 90*a* of the drive coupling 90) do not become the vertical status or the horizontal status at the same timing, the load fluctuation of the drive coupling 90 becomes small when the drive coupling 90 drives the toner container main body 32Y2. Consequently, the load fluctuation of the driving motor 80 becomes small and the variation of the amount of the toners supplied to the developing device 5Y by the toner carrying screw 62Y become small. Specifically, the amount of supplied toners and the variation of the amount of supplied toners were 0.18 grams/s±10 to 20%.

When the variation of the amount of the toners to be supplied to the developing device 5Y is small, the toner concentration in the developer G in the developing device 5Y becomes stable and the image density of an output image becomes stable.

In the experiment, the weight of the toners dropped from the toner dropping opening 64Ya of the toner supplying device 60Y was measured by rotating the driving motor for a predetermined period and the measured weight was divided by the measured period.

In addition, in the third embodiment of the present invention, as shown in FIGS. 20 and 25, the plural engaging members 32Y2*b* are positioned apart from the external circumferential surface of the toner container main body 32Y2. Therefore, the drive coupling 90 to be engaged with the engaging members 32Y2*b* of the toner container main body 32Y2 can be small.

In FIG. 25, regions surrounded by broken lines are movable regions of the claw members 90*a* of the drive coupling 90 (see FIG. 14B) in a case where the claw members 90*a* interfere with the engaging members 32Y2*b* when the toner container 32Y is attached to the toner supplying device 60Y. That is, in the interfering case, the contacting surfaces 90*a*1 of the claw members 90*a* do not engage with the contacting surfaces R of the engaging members 32Y2*b* and the tip surfaces of the contacting surfaces 90*a*1 hit the tips of the claw members 90*a*. However, in the movable regions, the status can be changed from a non-engaging status to an engaging status.

The cap 32Y1 is secured to the toner supplying device 60Y when the toner container 32Y is attached to the toner supplying device 60Y. That is, when the toner container 32Y is attached to the toner supplying device 60Y, the cap 32Y1 is not rotated and only the toner container main body 32Y2 rotatably sustained by the cap 32Y1 is rotated.

The sealing ability between the cap 32Y1 and the toner container main body 32Y2 is obtained by a sealing member 32Y20*b* adhered to a holding member 32Y1*b* of the cap 32Y1 (see FIGS. 23 and 24). That is, the end of the opening of the toner container main body 32Y2 brakes into the sealing member 32Y20*b* of the cap 32Y1. Therefore, the toners are not leaked from between the cap 32Y1 and the toner container main body 32Y2.

As shown in FIGS. 22 and 23, the cap 32Y1 includes the toner outlet W0, a shutter member 32Y1*a*, the electronic board 32Y1*c*, the protrusion members 32Y1*d* and 32Y1*e*, the guide rib 32Y1*f* (see FIG. 19), the holding member 32Y1*b*, and a flexible member 125.

The shutter member 32Y1*a* opens or closes the toner outlet W0 when the toner container 32Y is attached to or detached from the toner supplying device 60Y.

Specifically, when the toner container 32Y is attached to the toner supplying device 60Y, a user inserts the toner container 32Y into the toner container storing section (see FIG. 15) by holding the holding member 32Y1*b* of the toner container 32Y (see FIG. 19).

When the engaging members 32Y2*b* on the bottom section of the toner container 32Y1 are engaged with the drive coupling 90, the user rotates the holding member 32Yb2 clockwise by 90 degrees. With this, the shutter member 32Y1*a* is controlled not to rotate by engaging a control member (not shown) of the toner supplying device 60Y and the toner outlet W0 is opened. At this time, the toner outlet W0 engages an opening 60Ya of the toner tank 61Y (see FIG. 24), and the cap 32Y1 is secured to the toner supplying device 60Y. When the toner container 32Y is detached from the toner supplying device 60Y, operations in reverse to the above operations are executed.

In FIG. 22, a standing member W1 surrounds the toner outlet W0 and a guard W2 surrounds the standing member w1. The standing member W1 makes the sealing ability between the toner outlet W0 and the shutter member 32Y1*a* high by breaking into the flexible member 125 adhered onto the rear surface of the shutter member 32Y1*a* when the shutter member 32Y1*a* closes the toner outlet W0. In addition, the standing member W1 makes the sealing ability between the toner outlet W0 and the shutter member 32Y1*a* high by breaking into a flexible member 125 adhered onto a part surrounding the opening 60Ya of the toner tank 61Y when the shutter member 32Y1*a* opens the toner outlet W0.

The electronic board 32Y1*c* is formed of, for example, an RFID (radio frequency identification) circuit, and executes communications between the toner container 32Y and the image forming apparatus main body 100.

The protrusion members 32Y1*d* prevent a wrong toner container from being inserted into a toner container storing section. The protrusion members 32Y1*d* are formed, for example, when a manufacturer distributes an image forming apparatus with a brand name different from an original brand name and supplies a toner container with the different brand name. The electronic board 32Y1*c* is on an external circumferential surface of the toner container 32Y2 sandwiched between the protrusion members 32Y1*d* and the shutter member 32Y1*a* when the shutter member 32Y1*a* closes the toner outlet W0.

The protrusion members 32Y1*e* prevent a different color toner container from being inserted into an original color toner container storing section. In FIG. 22, the protrusion members 32Y1*e* for yellow color are shown. The positions of the protrusion members (ribs) are different among colors, yellow, magenta, cyan, and black, and the corresponding inserting openings are also different among colors, yellow, magenta, cyan, and black so that a color toner container can be inserted only into a correct opening.

In FIG. 19, the guide rib 32Y1*f* guides the toner container 32Y so that the toner container 32Y is inserted into the toner container storing section 31Y (see FIG. 15) with a correct posture.

As described above, in the third embodiment of the present invention, the engaging members 32Y2*b* formed on the bottom section of the toner container main body 32Y2 are disposed in a distribution angle θ other than 90 degrees and 180 degrees with the rotational axle center of the toner container main body 32Y2 as the reference. The engaging members 32Y2*b* are engaged with the claw members 90*a* of the drive coupling 90. With this, the load fluctuation to be applied to the drive coupling 90 (the driving motor 80) when the toner container 32Y is rotated can be lowered, and the variation of the amount of toners to be supplied to the developing device 5Y can be decreased.

Fourth Embodiment

Next, referring to the drawings, a fourth embodiment of the present invention is described. In the fourth embodiment of the present invention, the same reference number as that in the third embodiment of the present invention is used when a function of an element is almost identical to that in the third embodiment of the present invention.

Figure 27:
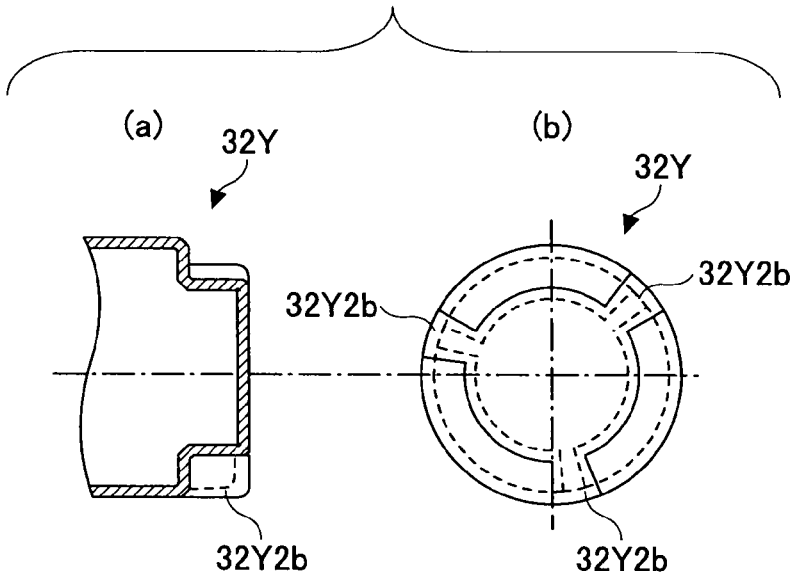
FIG. 27 is a schematic diagram showing a first bottom section of the toner container according to a fourth embodiment of the present invention.

FIG. 27 is a schematic diagram showing a first bottom section of the toner container 32Y according to the fourth embodiment of the present invention. In FIG. 27, (a) shows a side view of the first bottom section of the toner container 32Y, and (b) shows a bottom view of the first bottom section of the toner container 32Y. As shown in FIG. 27, the shape of the engaging member 32Y2*b* is different from that in the third embodiment of the present invention.

In the fourth embodiment of the present invention, similar to the third embodiment of the present invention, the toner container 32Y includes the cap 32Y1 (not shown) and the toner container main body 32Y2. In addition, similar to the third embodiment of the present invention, the three engaging members 32Y2*b* are disposed on the bottom section of the toner container 32Y in the distribution angle θ of 120 degrees.

As shown in FIG. 27, the engaging members 32Yb2 are formed at the external circumferential surface of the toner container main body 32Y2 on the first bottom section of the toner container 32Y. Therefore, the toners can be supplied into the convex section of the first bottom section of the toner container 32Y.

Since the engaging members 32Yb2 are formed at the external circumferential surface of the toner container main body 32Y2, the movable region (see FIG. 25) of the claw members 90*a* of the drive coupling 90 can be wider that that in the third embodiment of the present invention. Therefore, the size of the claw member 90*a* of the drive coupling 90 can be larger than that in the third embodiment of the present invention and the toner container main body 32Y2 can be rotated by a relatively low force. The shape of the claw member 90*a* of the drive coupling 90 is formed to meet the shape of the engaging member 32Y2*b*.

In the fourth embodiment of the present invention, when the number of the engaging members 32Y2*b* (the claw members 90*a*) is increased, the above effect can be increased. However, in this case, the movable regions of the claw members 90*a* are narrowed and the probability may be high that the claw members 90*a* interfere with the engaging members 32Y2*b* when the toner container 32Y is attached to the toner supplying device 60Y.

In the third embodiment of the present invention, the claw members 90*a* enter into a concave section of the bottom section of the toner container 32Y. Therefore, the size of the claw member 90*a* can be small; however, when the size of the claw member 90*a* is a relatively large size so as to obtain sufficient strength of the claw member 90*a*, the movable region of the claw member 90*a* is decreased. When the interference between the claw members 90*a* and the engaging members 32Y2*b* is small, the claw members 90*a* enter into the concave section by sliding on the engaging members 32Y2*b* due to a force of a compression spring (not shown) even if the interference occurs. However, when the number of the claw members 90*a* (the engaging members 32Y2*b*) is large and the interference becomes large, the claw members 90*a* do not enter into the concave section, and the apparatus may become defective. In the fourth embodiment of the present invention, the above problem can be surely prevented.

In the fourth embodiment of the present invention, the toner container main body 32Y2 can be formed of a relatively low-cost and high-rigidity material such as PET (polyethylene terephthalate). With this, the dimensional accuracy of the engaging members 32Y2*b* can be increased.

Figure 28:
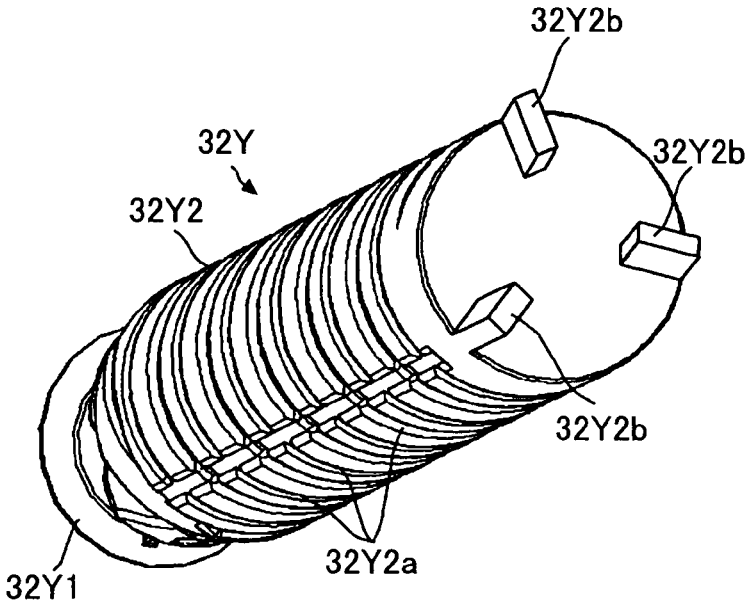
FIG. 28 is a perspective view of the toner container having a second bottom section according to the fourth embodiment of the present invention.
Figure 29:
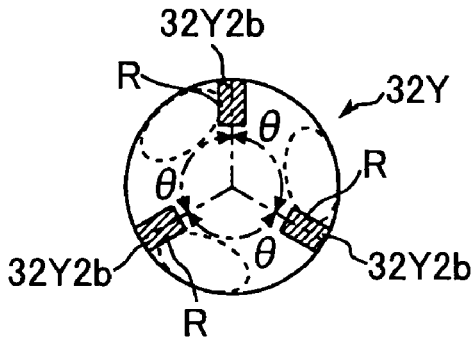
FIG. 29 is a bottom view of the toner container shown in FIG. 28.

FIG. 28 is a perspective view of the toner container 32Y having a second bottom section according to the fourth embodiment of the present invention. FIG. 29 is a bottom view of the toner container 32Y shown in FIG. 28.

As shown in the second bottom section of FIGS. 28 and 29, the second bottom section of the toner container 32Y does not have a convex section.

As shown in FIGS. 28 and 29, the plural engaging members 32Y2*b* are disposed near the external circumferential surface of the toner container main body 32Y on the bottom surface of the toner container 32Y. When the disposition of the engaging members 32Y2*b* is compared with that in the third embodiment of the present invention shown in FIG. 25, the size of the claw members 90*a* of the drive coupling 90 can be larger than that in the third embodiment of the present invention, and the toner container main body 32Y2 can be rotated by a force smaller than that in the third embodiment of the present invention.

Specifically, in the case shown in FIG. 29, since the movable region of the claw member 90*a* is larger than the case shown in FIG. 25, the size of the claw member 90*a* in the circumferential direction of the toner container 32Y can be larger than the case shown in FIG. 25. Consequently, mechanical strength of the claw member 90*a* can be higher than that of the case shown in FIG. 25. In addition, since the claw members 90*a* engage the engaging members 32Y2*b* at positions apart from the rotational center of the toner container main body 32Y2, the load to rotate the toner container main body 32Y2 can be smaller than that of the case shown in FIG. 25.

As described above, in the fourth embodiment of the present invention, the engaging members 32Y2*b* formed on the bottom of the toner container main body 32Y2 are disposed in a distribution angle θ other than 90 degrees and 180 degrees with the rotational axle center of the toner container main body 32Y2 as the reference. The engaging members 32Y2*b* are engaged with the claw members 90*a* of the drive coupling 90. With this, the load fluctuation can be further lowered when the toner container 32Y is rotated, and the variation of the amount of toners to be supplied to the developing device 5Y can be decreased.

Fifth Embodiment

Figure 30:
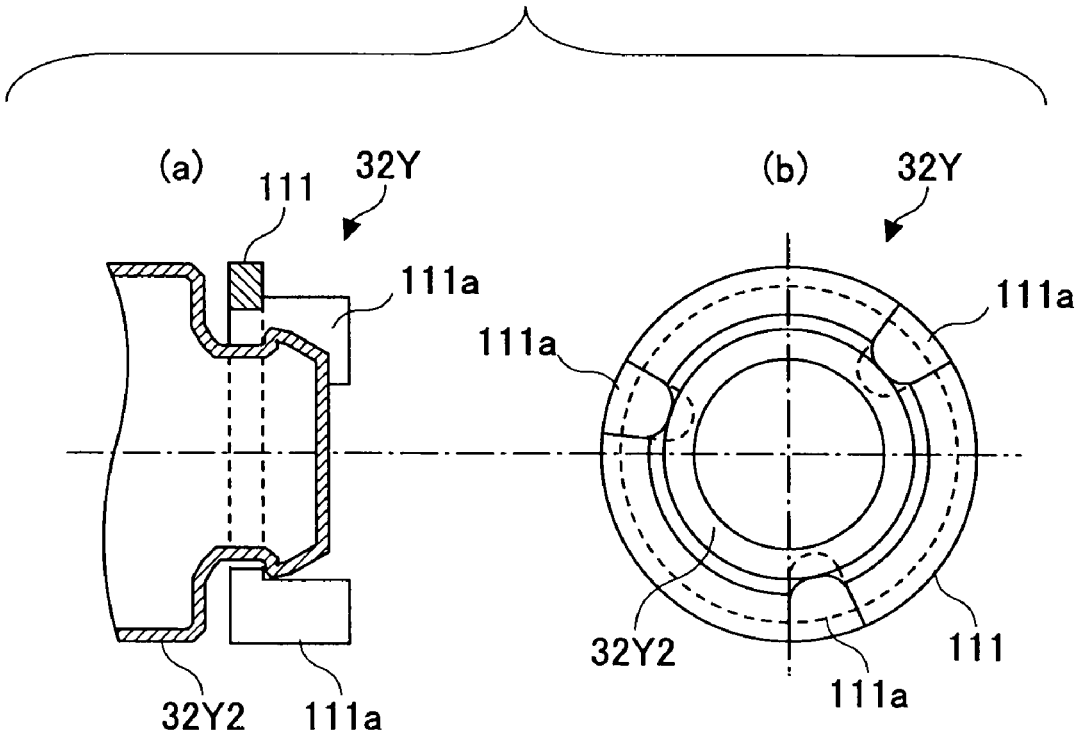
FIG. 30 is a schematic diagram showing a bottom section of the toner container according to a fifth embodiment of the present invention.

Referring to FIG. 30, a fifth embodiment of the present invention is described. In the fifth embodiment of the present invention, the same reference number as that in the third embodiment of the present invention is used when a function of an element is almost identical to that in the third embodiment of the present invention.

FIG. 30 is a schematic diagram showing a bottom section of the toner container 32Y according to the fifth embodiment of the present invention. In FIG. 30, (a) shows a side view of the bottom section of the toner container 32Y, and (b) shows a bottom view of the bottom section of the toner container 32Y. As shown in FIG. 30, in the fifth embodiment of the present invention, an engaging section 111 having engaging members 111*a* is engaged with a bottom section of the toner container main body 32Y2.

In the fifth embodiment of the present invention, similar to the third embodiment of the present invention, the toner container 32Y includes the cap 32Y1 (not shown) and the toner container main body 32Y2. In addition, similar to the third embodiment of the present invention, the three engaging members 111*a* are disposed on the bottom surface of the toner container 32Y in the distribution angle θ of 120 degrees.

Specifically, as shown in FIG. 30(*a*), the bottom section of the toner container main body 32Y2 provides a constricted section and the opening of the engaging section 111 is engaged into the constricted section. With this, the engaging section 111 is secured to the toner container main body 32Y2. Therefore, the rotational force is transmitted to the engaging members 111*a* from the drive coupling 90 (not shown), and the toner container main body 32Y2 is rotated together with the engaging section 111 in a predetermined direction.

In the fifth embodiment of the present invention, a material of the toner container main body 32Y2 can be different from a material of the engaging section 111 having the engaging members 111*a*. That is, the toner container main body 32Y2 which is not required to have high dimensional accuracy and great mechanical strength is formed of a low cost material by using injection molding, and the engaging section 111 having the engaging members 111*a* which is required to have high dimensional accuracy and great mechanical strength is formed of a suitable material to meet the requirement.

Specifically, the toner container main body 32Y2 is formed of polypropylene and the engaging section 111 is formed of polyacetal.

As described above, in the fifth embodiment of the present invention, the engaging members 111*a* positioned at the bottom section of the toner container main body 32Y2 are disposed in a distribution angle θ other than 90 degrees and 180 degrees with the rotational axle center of the toner container main body 32Y2 as the reference. The engaging members 111*a* are engaged with the claw members 90*a* of the drive coupling 90. With this, the load fluctuation can be lowered when the toner container 32Y is rotated, and the variation of the amount of toners to be supplied to the developing device 5Y can be decreased.

Sixth Embodiment

Figure 31:
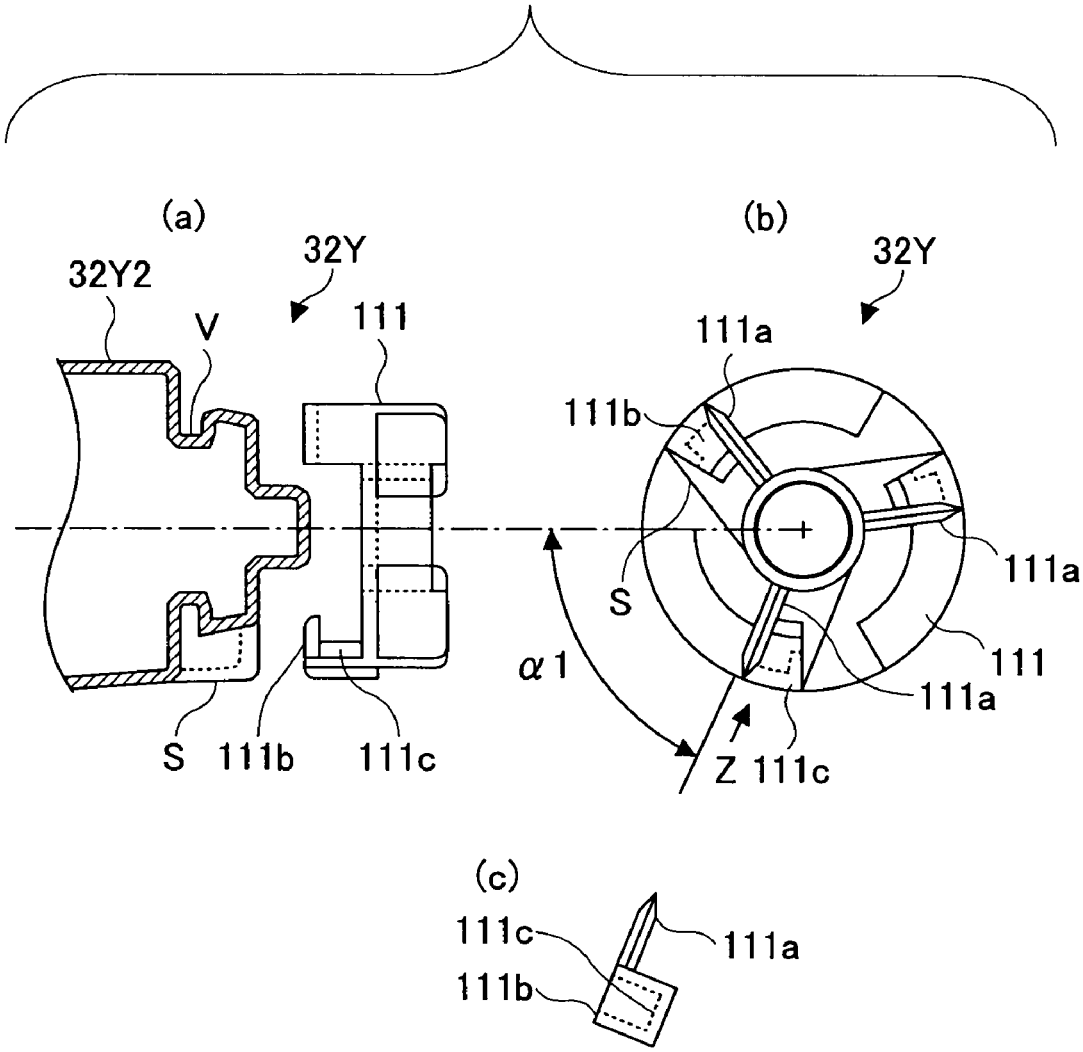
FIG. 31 is a schematic diagram showing a bottom section of the toner container according to a sixth embodiment of the present invention.

Referring to FIG. 31, a sixth embodiment of the present invention is described. In the sixth embodiment of the present invention, the same reference number as that in the third embodiment of the present invention is used when a function of an element is almost identical to that in the third embodiment of the present invention.

FIG. 31 is a schematic diagram showing a bottom section of the toner container 32Y according to the sixth embodiment of the present invention. In FIG. 31, (a) shows a side view of the bottom section of the toner container 32Y, (b) shows a bottom view of the bottom section of the toner container 32Y, and (c) shows a part of the engaging section 111 taken from the Z direction shown in FIG. 31(*b*).

As shown in FIG. 31, in the sixth embodiment of the present invention, an engaging section 111 having engaging members 111*a* is engaged with the bottom section of the toner container main body 32Y2. The engaging section 111 is rotated in a predetermined range, and the tip of the engaging member 111*a* is tapered.

In the sixth embodiment of the present invention, similar to the third embodiment of the present invention, the toner container 32Y includes the cap 32Y1 (not shown) and the toner container main body 32Y2. In addition, similar to the third embodiment of the present invention, the three engaging members 111*a* of the engaging section 111 are disposed on the bottom surface of the toner container 32Y in the distribution angle θ of 120 degrees.

As shown in FIG. 31(*b*), the engaging section 111 is rotatably engaged with the bottom section of the toner container main body 32Y2 in a predetermined range α1.

Specifically, the engaging section 111 includes the three engaging members 111*a*, claw members 111*b*, and wall portions 111*c*. When the engaging section 111 is engaged with the bottom section of the toner container main body 32Y2 so that a bearing section (hole section) of the engaging section 111 is pushed to meet a boss section of the bottom section of the toner container main body 32Y2, the wall portions 111*c* are engaged with a groove V of the toner container main body 32Y2, and the engaging section 111 is engaged with the bottom section of the toner container main body 32Y2 so that the engaging section 111 is not pulled out from the toner container main body 32Y2 in the axle direction of the toner container main body 32Y2. At this time, the engaging section 111 is engaged with the bottom section of the toner container main body 32Y2 in a range of approximately 65 degrees in the circumferential direction of the toner container main body 32Y2. That is, the range is from a stopper S of the toner container main body 32Y2 to the side surface of the claw member 111*b*.

When side surfaces of the engaging members 111*a* of the engaging section 111 contact the corresponding contacting surfaces 90*a*1 of the claw members 90*a* of the drive coupling 90 (see FIG. 14B), a rotational force is transmitted to the engaging section 111 from the dive coupling 90. Then the wall portions 111*c* of the engaging section 111 contact the stoppers S of the toner container main body 32Y2 and the rotational force is transmitted from the engaging section 111 to the toner container main body 32Y2. With this, the toner container main body 32Y2 and the engaging section 111 are rotated in the predetermined same direction.

In the sixth embodiment of the present invention, a material of the toner container main body 32Y2 can be different from a material of the engaging section 111 having the engaging members 111*a*. That is, the engaging section 111 which is required to have high dimensional accuracy and high rigidity is formed of a resin material, for example, polystyrene, polycarbonate, polyacetal, and ABS. The toner container main body 32Y2 is formed of a low cost material by using blow molding, for example, polypropylene, and polypropylene terephthalate.

In addition, in the sixth embodiment of the present invention, the engaging section 111 is formed to have a thin plate shape. As shown in FIG. 31(*c*), the tip of the engaging member 111*a* is tapered.

When the toner container 32Y is attached to the toner supplying device 60Y, the probability of the claw members 90*a* interfering with the corresponding engaging members 111*a* can be decreased by the shape of the engaging members 111*a*. Even if the claw members 90*a* interfere with the corresponding engaging members 111*a*, since the tip of the engaging member 111*a* is tapered and the engaging section 111 can be rotated in the predetermined range $\alpha 1$ for the toner container main body 32Y2, the claw members 90*a* are likely to be moved to the movable region.

In the sixth embodiment of the present invention, the thickness of the engaging members 111*a* is approximately 2 mm. With this, the probability of the claw members 90*a* interfering with the corresponding engaging members 111*a* can be decreased. Even if the claw member 90*a* hits the engaging member 111*a*, the strength of the engaging member 111*a* is sufficiently great.

As described above, in the sixth embodiment of the present invention, similar to the third through fifth embodiments of the present invention, the engaging members 111*a* positioned at the bottom section of the toner container main body 32Y2 are disposed in a distribution angle $\theta$ other than 90 degrees and 180 degrees with the rotational axle center of the toner container main body 32Y2 as the reference. With this, the load fluctuation at the drive coupling 90 when the toner container 32Y is rotated can be lowered, and the variation of the amount of toners to be supplied to the developing device 5Y can be decreased.

In the third through sixth embodiments of the present invention, the toner containers 32Y, 32M, 32C, and 32K only contain the corresponding toners. However, the toner containers 32Y, 32M, 32C, and 32K can contain corresponding two-component developers formed of toners and a toner carrier. In this case, the same effects as those in the third through sixth embodiments of the present invention can be obtained.

In addition, in the third through sixth embodiments of the present invention, a part or all of the corresponding image forming sections 6Y, 6M, 6C, and 6K can be included in the corresponding process cartridges. In this case, the same effects as those in the third through sixth embodiments of the present invention can be obtained.

In the third through sixth embodiments of the present invention, there are provided toner containers 32Y, 32M, 32C, and 32K detachably disposed from an image forming apparatus main body 100. When one toner container 32Y in the plural toner containers 32Y, 32M, 32C, and 32K is described, the toner container 32Y includes a toner container main body 32Y2 having a spiral protrusion on an inner wall of the toner container main body 32Y2 which is rotatably sustained by the image forming apparatus main body 100. The toner container main body 32Y2 includes an opening for discharging toners stored in the toner container main body 32Y2 at one end in the long length direction and plural engaging members 32Yb2 for engaging with plural claw members 90*a* of a drive coupling 90 disposed in the image forming apparatus main body 100 at a bottom section of the toner container main body 32Y2 at the other end in the long length direction. The plural engaging members 32Y2*b* formed on the bottom section of the toner container main body 32Y2 are disposed in a distribution angle other than 90 degrees and 180 degrees with the rotational axle center of the toner container main body 32Y2 as the reference.

In addition, the plural engaging members 32Y2*b* are formed on the bottom section of the toner container main body 32Y2 at corresponding positions near the external circumferential surface of the toner container main body 32Y2.

In addition, plural engaging members 111*a* are formed in an engaging section 111 capable of engaging with the toner container main body 32Y2, the engaging section 111 is engaged with the toner container main body 32Y2, and the engaging section 111 including the plural engaging members 111*a* is formed of a material whose dimensional accuracy is higher than a material of the toner container main body 32Y2.

In addition, the engaging section 111 is capable of rotating within a predetermined region for the toner container main body 32Y2.

In addition, the engaging section 111 is formed by a thin plate shape, and the tip of the engaging member 111*a* to be engaged with the claw member 90*a* of the drive coupling 90 is tapered.

The number of the engaging members 111*a* is three and the engaging members 111*a* are disposed in the engaging section 111 in the distribution angle of 120 degrees with the rotational axle center of the toner container main body 32Y2 as the reference.

In addition, the toner container 32Y includes a cap 32Y1 which is secured to the image forming apparatus main body 100 when the toner container 32Y is attached to the image forming apparatus main body 100 and is relatively rotated for the toner container main body 32Y2. The cap 32Y1 includes a toner outlet connecting the opening of the toner container main body 32Y2 and a shutter member 32Y1*a* for opening or closing the toner outlet when the toner container 32Y is attached to or detached from the image forming apparatus main body 100.

In addition, there is provided an image forming apparatus. The image forming apparatus includes the toner containers 32Y, 32M, 32C, and 32K described above.

Further, the present invention is not limited to the specifically disclosed embodiments, and variations and modifications may be made without departing from the scope of the present invention. That is, in the embodiments of the present invention, the number of elements, the positions of the corresponding elements, and the shapes of the corresponding elements are not limited to the specifically disclosed embodiments.

The present invention is based on Japanese Priority Patent Application No. 2007-111364, filed on Apr. 20, 2007, Japanese Priority Patent Application No. 2008-012413, filed on Jan. 23, 2008, and Japanese Priority Patent Application No. 2008-024647, filed on Feb. 5, 2008, with the Japanese Patent Office, the entire contents of which are hereby incorporated herein by reference.

What is claimed is:

1. An image forming apparatus, comprising:

a plurality of toner supplying devices;

a plurality of toner containers; and a plurality of developing devices; wherein the plural toner supplying devices supply toners stored in the corresponding toner containers to the corresponding developing devices; and each of the toner supplying devices include a toner tank which stores the toner discharged from the toner container;

a toner carrying section which carries the toner stored in the toner tank;

a toner dropping route which causes the toner carried by the toner carrying section to drop into the developing device by toner own weight; and a control unit which controls an amount of the toner to flow into the toner dropping route, wherein the control unit includes a magnetic field generating unit for generating a magnetic field in the toner carrying section; and a magnetic substance which is sustained in the toner carrying section by the magnetic field generated by the magnetic field generating unit, wherein an upper portion of the magnetic field generating unit is obliquely disposed at the toner carrying section.

2. The image forming apparatus as claimed in claim 1, wherein:

the toner carrying section carries the toner in an obliquely upward direction.

3. The image forming apparatus as claimed in claim 2, wherein:

the toner carrying section linearly carries the toner stored in the toner tank from a bottom section of the toner tank to a position above the developing device.

4. The image forming apparatus as claimed in claim 2, wherein:

the toner carrying section is slanted by 5 degrees or more relative to the horizontal direction.

5. The image forming apparatus as claimed in claim 1, wherein:

the toner carrying section includes a toner carrying screw which carries the toner by being rotated in a predetermined direction; and a toner carrying tube having an internal wall in which the toner carrying screw is disposed.

6. The image forming apparatus as claimed in claim 5, wherein:

a toner carrying length from the toner tank to the toner dropping route in the toner carrying tube is 1.5 times or more a screw pitch of the toner carrying screw.

7. The image forming apparatus as claimed in claim 1, wherein:

the thickness of the toner carrying section where the magnetic field generating unit is formed is less than the thickness of the toner carrying section where the magnetic field generating unit is not formed.

8. The image forming apparatus as claimed in claim 7, wherein:

the magnetic field generating unit is formed on an external circumferential surfaces of the toner carrying section.

9. The image forming apparatus as claimed in claim 1, wherein:

the magnetic field generating unit is formed of a permanent magnet, and the magnetization direction of the permanent magnet is towards an inside of the toner carrying section.

10. The image forming apparatus as claimed in claim 1, wherein:

a magnetic force of the magnetic field generating unit is 50 mT or more.

11. The image forming apparatus as claimed in claim 1, wherein:

the magnetic substance is a toner carrier.

12. The image forming apparatus as claimed in claim 1, wherein:

each of the toner containers stores a toner carrier in addition to the toner and supplies the toner and the toner carrier to the corresponding developing devices.

13. The image forming apparatus as claimed in claim 1, wherein:

the toner carrying section carries the toner in an obliquely upward direction.

14. The image forming apparatus as claimed in claim 13, wherein:

the toner carrying section linearly carries the toner stored in the toner tank from a bottom section of the toner tank to a position above the developing device.

15. The image forming apparatus as claimed in claim 14, wherein:

the toner carrying section is slanted by 5 degrees or more relative to the horizontal direction.

16. The image forming apparatus as claimed in claim 15, wherein:

the toner carrying section includes a toner carrying screw which carries the toner by being rotated in a predetermined direction; and a toner carrying tube having an internal wall in which the toner carrying screw is disposed.

17. The image forming apparatus as claimed in claim 16, wherein:

a toner carrying length from the toner tank to the toner dropping route in the toner carrying tube is 1.5 times or more a screw pitch of the toner carrying screw.

18. The image forming apparatus as claimed in claim 1, wherein:

the magnetic field generating unit is on an external circumferential surface of the toner carrying section.

19. The image forming apparatus as claimed in claim 18, wherein:

the magnetic field generating unit includes a permanent magnet, and the magnetization direction of the permanent magnet is towards an inside of each of the toner carrying section.

20. The image forming apparatus as claimed in claim 1, wherein:

the upper portion of the magnetic field generating unit is obliquely wound around the toner carrying section.

* * * * *